US010165828B2

(12) United States Patent
Farris et al.

(10) Patent No.: US 10,165,828 B2
(45) Date of Patent: Jan. 1, 2019

(54) ARTICLE OF FOOTWEAR WITH DECOUPLED UPPER

(71) Applicant: NIKE, Inc., Beaverton, OR (US)

(72) Inventors: Bryan N. Farris, North Plains, OR (US); Olivier Henrichot, Lake Oswego, OR (US); Jeffrey C. Pisciotta, Oregon City, OR (US)

(73) Assignee: NIKE, Inc., Beaverton, OR (US)

( * ) Notice: Subject to any disclaimer, the term of this patent is extended or adjusted under 35 U.S.C. 154(b) by 44 days.

(21) Appl. No.: 14/818,643

(22) Filed: Aug. 5, 2015

(65) Prior Publication Data

US 2016/0007683 A1 Jan. 14, 2016

Related U.S. Application Data

(62) Division of application No. 13/021,126, filed on Feb. 4, 2011, now Pat. No. 9,107,474.

(51) Int. Cl.

| | |
|---|---|
| ***A43B 7/14*** | (2006.01) |
| ***A43B 13/12*** | (2006.01) |
| ***A43B 13/14*** | (2006.01) |
| ***A43B 13/28*** | (2006.01) |
| ***A43B 23/02*** | (2006.01) |
| ***A43B 3/26*** | (2006.01) |
| ***A43C 5/00*** | (2006.01) |
| ***A43B 13/42*** | (2006.01) |

(52) U.S. Cl.

CPC ..... *A43B 13/28* (2013.01); *A43B 3/26* (2013.01); *A43B 7/14* (2013.01); *A43B 13/12* (2013.01); *A43B 13/125* (2013.01); *A43B 13/141* (2013.01); *A43B 13/42* (2013.01); *A43B 23/026* (2013.01); *A43B 23/0245* (2013.01); *A43B 23/0265* (2013.01); *A43C 5/00* (2013.01); *A43B 7/1495* (2013.01)

(58) Field of Classification Search

CPC ..... A43B 3/26; A43B 7/1495; A43B 13/12; A43B 13/125; A43B 13/127; A43B 13/14; A43B 13/141; A43B 13/28

USPC ..... 36/12, 25 R, 45, 55, 88, 93, 97

See application file for complete search history.

(56) References Cited

U.S. PATENT DOCUMENTS

| | | | |
|---|---|---|---|
| 210,920 | A | 12/1878 | Copeland |
| 1,072,916 | A | 9/1913 | Crawford |
| 1,354,972 | A | 10/1920 | Hess |
| 1,795,222 | A | 3/1931 | Lifschutz |
| 1,952,538 | A | 3/1934 | Devine et al. |
| 2,769,251 | A | 11/1956 | Elsey |

(Continued)

FOREIGN PATENT DOCUMENTS

| | | | |
|---|---|---|---|
| WO | 9408478 | A1 | 4/1994 |
| WO | 0187106 | A2 | 11/2001 |

OTHER PUBLICATIONS

International Search Report and Written Opinion for Application No. PCT/US2012/023605, dated Oct. 15, 2012.

(Continued)

*Primary Examiner* — Sharon M Prange

(74) *Attorney, Agent, or Firm* — Banner & Witcoff, Ltd.

(57) ABSTRACT

An article of footwear including a connecting member is disclosed. The connecting member provides partial decoupling between the upper and the sole structure. The connecting member can include an upper layer and a lower layer that are attached at a central attachment portion.

18 Claims, 38 Drawing Sheets

(56) References Cited

U.S. PATENT DOCUMENTS

| | | | | |
|---|---|---|---|---|
| 2,933,834 | A | 4/1960 | Fredrick | |
| 3,323,232 | A | 6/1967 | Danowsky et al. | |
| 3,404,468 | A | 10/1968 | Rosen | |
| 3,541,708 | A | 11/1970 | Rosen | |
| 3,586,003 | A * | 6/1971 | Baker | A43B 7/1495 36/145 |
| 4,296,558 | A | 10/1981 | Antonious | |
| 4,322,895 | A | 4/1982 | Hockerson | |
| 4,550,511 | A | 11/1985 | Gamm | |
| 4,638,576 | A | 1/1987 | Parracho et al. | |
| 4,794,706 | A | 1/1989 | Puckhaber et al. | |
| 4,858,341 | A | 8/1989 | Rosen | |
| 4,860,464 | A | 8/1989 | Misevich et al. | |
| 4,924,605 | A | 5/1990 | Spademan | |
| 4,926,569 | A | 5/1990 | Bunch | |
| 5,426,869 | A | 6/1995 | Gore et al. | |
| 5,896,608 | A | 4/1999 | Whatley | |
| 6,004,891 | A | 12/1999 | Tuppin et al. | |
| 6,393,733 | B1 | 5/2002 | London et al. | |
| 6,678,970 | B2 | 1/2004 | Liu | |
| 6,694,642 | B2 | 2/2004 | Turner | |
| 6,925,734 | B1 | 8/2005 | Schaeffer | |
| 6,948,262 | B2 | 9/2005 | Kerrigan | |
| 7,159,339 | B2 | 1/2007 | Mathieu et al. | |
| D546,043 | S | 7/2007 | Belley et al. | |
| 7,254,905 | B2 | 8/2007 | Dennison | |
| 7,290,357 | B2 | 11/2007 | McDonald et al. | |
| 7,320,188 | B2 | 1/2008 | Bathum | |
| 7,337,558 | B2 | 3/2008 | Terlizzi et al. | |
| 7,395,616 | B2 | 7/2008 | Fallon et al. | |
| 7,418,790 | B2 | 9/2008 | Kerrigan | |
| 7,574,818 | B2 | 8/2009 | Meschter | |
| 8,387,278 | B2 | 3/2013 | Rees | |
| 8,387,279 | B2 | 3/2013 | Pauk et al. | |
| 8,857,077 | B2 | 10/2014 | Kahatsu et al. | |
| 8,959,799 | B2 | 2/2015 | Nishiwaki et al. | |
| 2004/0040183 | A1 | 3/2004 | Kerrigan | |
| 2005/0120592 | A1 | 6/2005 | Rodriguez | |
| 2005/0138846 | A1 | 6/2005 | O'Connor | |
| 2006/0086004 | A1 | 4/2006 | Davis et al. | |
| 2006/0117606 | A1 | 6/2006 | Chen et al. | |
| 2007/0084081 | A1 | 4/2007 | Fallon | |
| 2007/0107264 | A1 | 5/2007 | Meschter et al. | |
| 2007/0271822 | A1 | 11/2007 | Meschter | |
| 2007/0271823 | A1 | 11/2007 | Meschter | |
| 2009/0090027 | A1 | 4/2009 | Baudouin | |
| 2009/0178303 | A1 | 7/2009 | Hurd et al. | |
| 2010/0083535 | A1 | 4/2010 | Meschter et al. | |
| 2012/0011744 | A1 | 1/2012 | Bell et al. | |
| 2012/0079741 | A1 | 4/2012 | Kohatsu | |
| 2012/0124866 | A1 | 5/2012 | Moriyasu et al. | |
| 2013/0192091 | A1 | 8/2013 | Kohatsu et al. | |

OTHER PUBLICATIONS

International Preliminary Report on Patentability and Written Opinion for Application No. PCT/US2012/023605, dated Aug. 15, 2013.

Office Action dated Mar. 12, 2015 for Chinese Application No. 201280007528.0.

Partial International Search Report for Application No. PCT/US2012/023605, dated Aug. 8, 2012.

Office Action dated Oct. 9, 2015 for Chinese Application No. 201280007528.0.

Apr. 5, 2017—(CN) ISR—Appl. No. 201610238180.6.

* cited by examiner

ARTICLE OF FOOTWEAR WITH DECOUPLED UPPER

CROSS-REFERENCE TO RELATED APPLICATIONS

This application is a divisional of Farris et al., U.S. patent application Ser. No. 13/021,126, published as U.S. Publication Number 2012/0198720, published on Aug. 9, 2012, entitled "Article of Footwear with Decoupled Upper," the disclosure of which is entirely incorporated herein by reference.

BACKGROUND

The present invention relates generally to an article of footwear, and in particular to an article of footwear with a decoupled upper.

Mathieu et al. (U.S. Pat. No. 7,159,339) teaches a bottom assembly for an article of footwear. Mathieu teaches an article of footwear having an upper and an outer bottom assembly, the outer bottom assembly having an outsole and, in the heel zone, an elastically deformable element that is substantially arch-shaped in the transverse direction and extends downward from the lower end of the upper to the medial and lateral edges, respectively, of the outsole.

SUMMARY

In one aspect, the invention provides an article of footwear, comprising: a longitudinal direction extending along a major axis the article of footwear and a lateral direction extending along a minor axis of the article of footwear; an upper and a sole structure; a connecting member including an upper layer and a lower layer, the upper layer being attached to the lower layer at a central attachment portion that extends longitudinally along the connecting member; the upper layer being attached to the upper and the lower layer being attached to the sole structure; the connecting member including a decoupled portion extending laterally from the central attachment portion and including a first free portion of the upper layer and a second free portion of the lower layer, the first free portion being configured to move substantially independently of the second free portion; and wherein the decoupled portion has a lateral width that is substantially greater than a lateral width of the central attachment portion.

In another aspect, the invention provides an article of footwear, comprising: a longitudinal direction extending along a major axis the article of footwear and a lateral direction extending along a minor axis of the article of footwear; an upper and a sole structure; a connecting member including an upper layer and a lower layer, the upper layer being attached to the lower layer at a central attachment portion that extends longitudinally along the connecting member; the upper layer being attached to the upper and the lower layer being attached to the sole structure; the connecting member including a decoupled portion extending laterally from the central attachment portion and including a first free portion of the upper layer and a second free portion of the lower layer; a strap including a first end portion attached to the first free portion and a second end portion disposed adjacent to a lacing region of the upper; and wherein the strap can be used to adjust the width of the upper.

In another aspect, the invention provides an article of footwear, comprising: a longitudinal direction extending along a major axis the article of footwear and a lateral direction extending along a minor axis of the article of footwear; an upper and a sole structure; a connecting member including an upper layer and a lower layer, the upper layer being attached to the lower layer at a central attachment portion that extends longitudinally along the connecting member; the upper layer being attached to the upper and the lower layer being attached to the sole structure; the connecting member including a decoupled portion extending laterally from the central attachment portion and including a first free portion of the upper layer and a second free portion of the lower layer; an opening disposed between the first free portion and the second free portion; a covering portion having an end portion disposed adjacent to an upper periphery of the sole structure; and wherein the covering portion is configured to cover the opening between the first free portion and the second free portion.

In another aspect, the invention provides an article of footwear, comprising: a longitudinal direction extending along a major axis the article of footwear and a lateral direction extending along a minor axis of the article of footwear; an upper and a sole structure; the upper including an integral strap portion that is continuously formed with the upper, the integral strap portion extending from the lower periphery of the upper to a lacing region of the upper; a connecting member including an upper layer and a lower layer, the upper layer being attached to the lower layer at a central attachment portion that extends longitudinally along the connecting member; the upper layer being attached to the upper and the lower layer being attached to the sole structure; the connecting member including a decoupled portion extending laterally from the central attachment portion and including a first free portion of the upper layer and a second free portion of the lower layer; and wherein the first free portion of the upper layer is disposed adjacent to an end portion of the integral strap.

In another aspect, the invention provides an article of footwear, comprising: a longitudinal direction extending along a major axis the article of footwear and a lateral direction extending along a minor axis of the article of footwear; an upper and a sole structure; a connecting member comprising an upper portion, a lower portion and a sidewall extending between an upper periphery and a lower periphery; the upper portion connecting to the upper and the lower portion connecting to the sole structure; the lower portion having a plurality of markings; and wherein the markings are used to select an attachment region between the lower portion and the sole structure.

In another aspect, the invention provides an article of footwear, comprising: a longitudinal direction extending along a major axis the article of footwear and a lateral direction extending along a minor axis of the article of footwear; an upper and a sole structure; a connecting member including an upper layer and a lower layer, the upper layer being attached to the lower layer at a central attachment portion that extends longitudinally along the connecting member; the upper layer being attached to the upper and the lower layer being attached to the sole structure; and wherein a plurality of threads are disposed on a portion of the upper layer, and wherein the plurality of threads are configured to provide structural support to the upper layer.

In another aspect, the invention provides an article of footwear, comprising: a longitudinal direction extending along a major axis the article of footwear and a lateral direction extending along a minor axis of the article of footwear; an upper and a sole structure; the upper comprising a lacing region including a first lacing edge and a second lacing edge that is disposed opposite of the first lacing edge; a layer configured to provide support to a foot when the article is worn; a plurality of threads disposed on a portion of the layer; and wherein the plurality of threads extend continuously from the first lacing edge to the second lacing edge.

In another aspect, the invention provides an article of footwear comprising: a longitudinal direction extending along a major axis the article of footwear and a lateral direction extending along a minor axis of the article of footwear; an upper and a sole structure; a layer configured to provide support to a foot when the article is worn; a plurality of threads disposed on a surface of the layer; and wherein the plurality of threads are disposed beneath a bottom portion of a foot when the article is worn.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
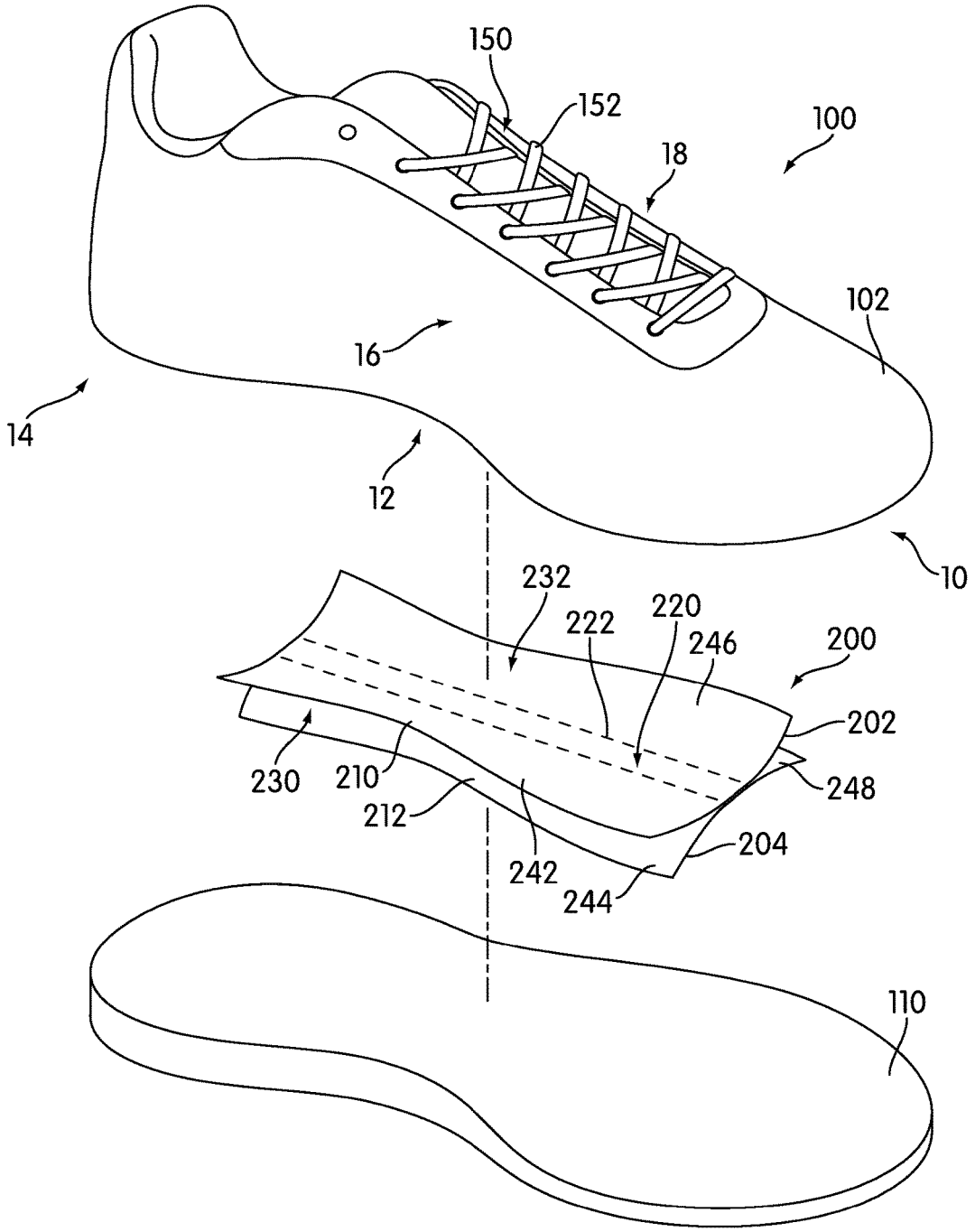
FIG. 1 is an isometric exploded view of an embodiment of an article of footwear.

FIG. 1 illustrates an isometric exploded view of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. Article 100 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot portion to a heel portion of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Article 100 can include sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural surfaces (such as grass), synthetic surfaces (such as synthetic turf), dirt, as well as other surfaces.

Sole structure 110 extends between the foot and the ground when article 100 is worn. In different embodiments, sole structure 110 may include different components. For example, sole structure 110 may include an outsole, a midsole, and/or an insole. In some cases, one or more of these components may be optional.

In some embodiments, article of footwear 100 may include a fastening system configured to tighten upper 102. Generally, article of footwear 100 could be associated with any type of fastening system including, but not limited to: laces, straps, zippers, hook and loop fasteners, as well as other types of fastening systems. In an exemplary embodiment, article of footwear 100 includes a lacing system that comprises lacing region 150 and lace 152. Lace 152 can be used to tighten lacing region 150 in order to pull lateral side 16 and medial side 18 of upper 102 together.

An article of footwear can include provisions for controlling the coupling between an upper and a sole. In some embodiments, an upper may be selectively connected to various regions of the top of a sole. In other embodiments, an upper and a sole may be attached using an intermediate connecting member. In an exemplary embodiment, an upper may be attached to a sole structure using a connecting member with one or more decoupled portions.

Figure 2:
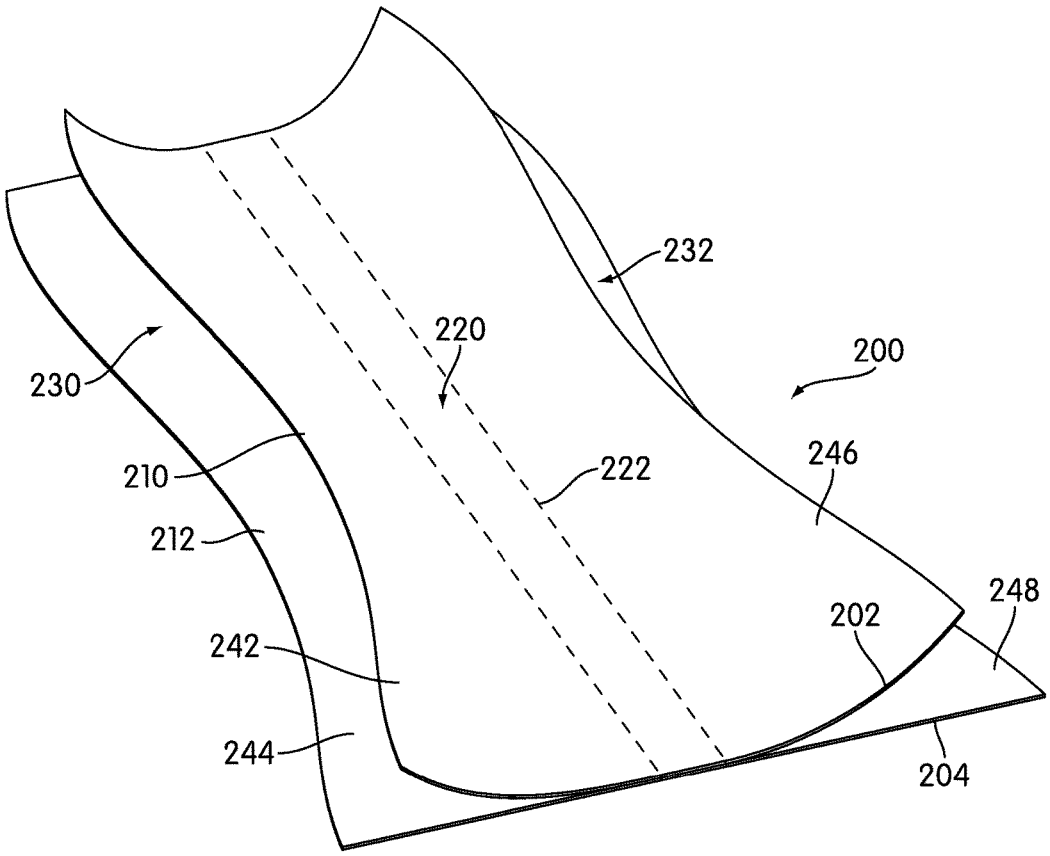
FIG. 2 is an isometric view of an embodiment of a connecting member for an article of footwear.

Referring now to FIGS. 1 and 2, article of footwear 100 can include connecting member 200. Connecting member 200 may generally be disposed between upper 102 and sole structure 110 and may be used for connecting portions of upper 102 to portions of sole structure 110. In particular, the current embodiment illustrates connecting member 200 being generally disposed between upper 102 and sole structure 110 at midfoot portion 12 of article 100, as well as some portions of forefoot portion 10 and heel portion 14.

In some embodiments, connecting member 200 may further comprise a layered structure. In some cases, connecting member 200 may comprise two layers. In other cases, connecting member 200 may comprise more than two layers. In one embodiment, connecting member 200 may comprise upper layer 202 and lower layer 204.

Generally, the geometries of upper layer 202 and lower layer 204 can vary. In some cases, upper layer 202 and lower layer 204 may have substantially planar geometries such that the thickness of each layer is substantially less than the associated lengths and widths of each layer. In addition, in some cases, upper periphery 210 of upper layer 202 and lower periphery 212 of lower layer 204 may be contoured in a manner to correspond to the contouring of upper 102 and sole structure 110.

In different embodiments, the dimensions of upper layer 202 and/or lower layer 204 can vary. In one embodiment, upper layer 202 and lower layer 204 can have substantially similar thicknesses. In another embodiment, upper layer 202 could have a substantially greater thickness than lower layer 204. In still another embodiment, lower layer 204 could have a substantially greater thickness than upper layer 202. Furthermore, in some cases the lengths of upper layer 202 and lower layer 204 could be substantially similar. In other cases, the lengths of upper layer 202 and lower layer 204 could be substantially different. Still further, in some cases, the widths of upper layer 202 and lower layer 204 could be substantially similar. In other cases, the widths of upper layer 202 and lower layer 204 could be substantially different. For example, in one embodiment upper layer 202 may be substantially wider than lower layer 204 so that portions of upper layer 202 may be wrapped around the sides of upper 102.

Upper layer 202 and lower layer 204 may be joined at central attachment portion 220. In particular, central attachment portion 220 is a substantially narrow portion that extends longitudinally through connecting member 200. Upper layer 202 and lower layer 204 can be attached using any means known in the art. In some cases, upper layer 202 could be attached to lower layer 204 by stitching. In other cases, upper layer 202 could be attached to lower layer 204 using an adhesive of some kind. It will be understood that the method of attaching upper layer 202 to lower layer 204 can be selected according to the material properties of upper layer 202 and lower layer 204, as well as desired structural properties for connecting member 200. In an exemplary embodiment, upper layer 202 may be attached to lower layer 204 using stitching 222.

Connecting member 200 may comprise one or more decoupled portions. In the current embodiment, connecting member 200 includes first decoupled portion 230 and second decoupled portion 232. First decoupled portion 230 extends generally laterally from central attachment portion 220 to lateral side 16 of connecting member 200. Moreover, first decoupled portion 230 includes first free portion 242 of upper layer 202 and first free portion 244 of lower layer 204. Second decoupled portion 232 extends generally laterally from central attachment portion 220 to medial side 18 of connecting member 200. Moreover, second decouple portion 232 includes second free portion 246 of upper layer 202 and second free portion 248 of lower layer 204. With this arrangement, first free portion 242 of upper layer 202 may be configured to move substantially independently of first free portion 244 of lower layer 204. Likewise, second free portion 246 of upper layer 202 may be configured to move substantially independently of second free portion 248 of lower layer 204.

Figure 3:
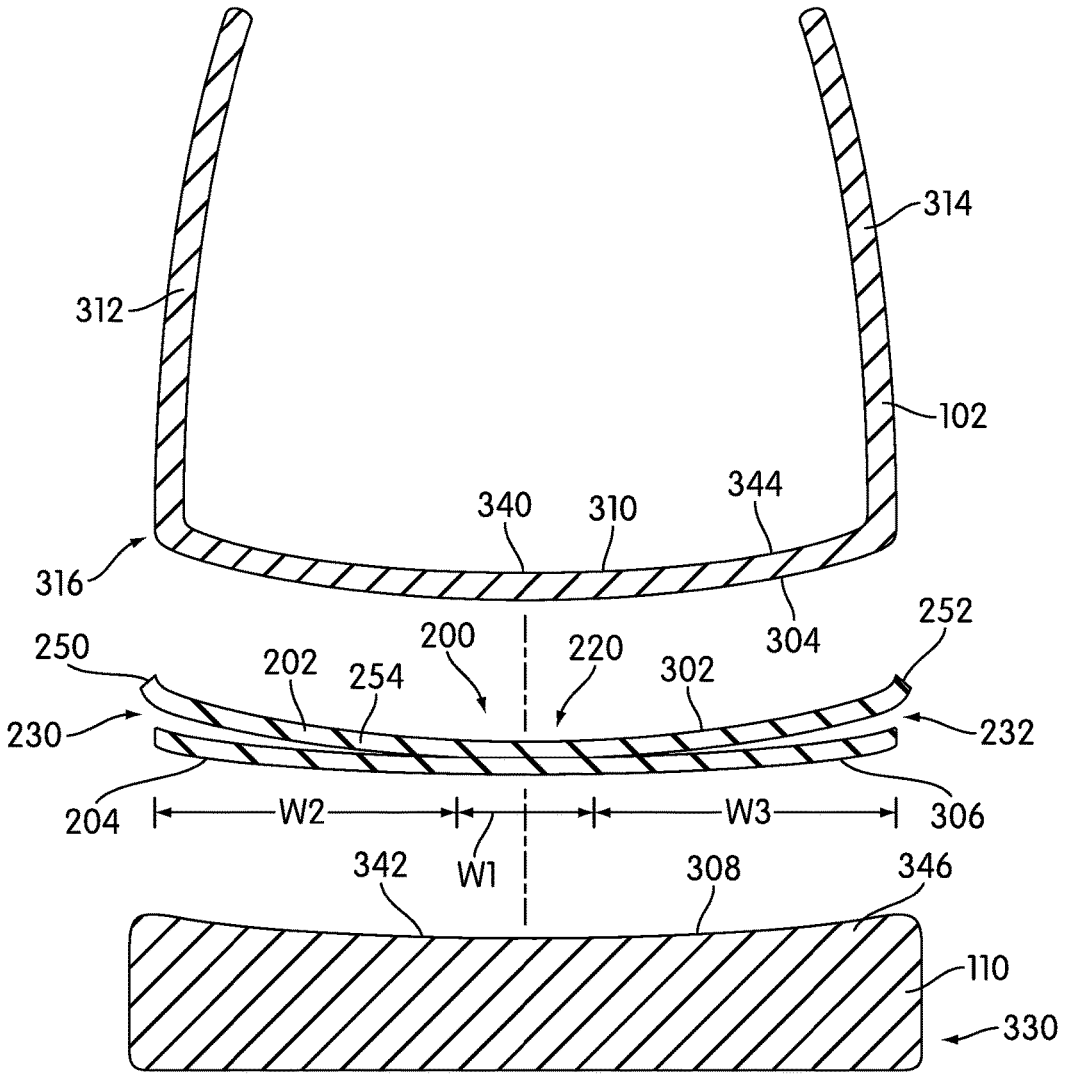
FIG. 3 is an exploded cross-sectional view of an embodiment of an article of footwear.
Figure 4:
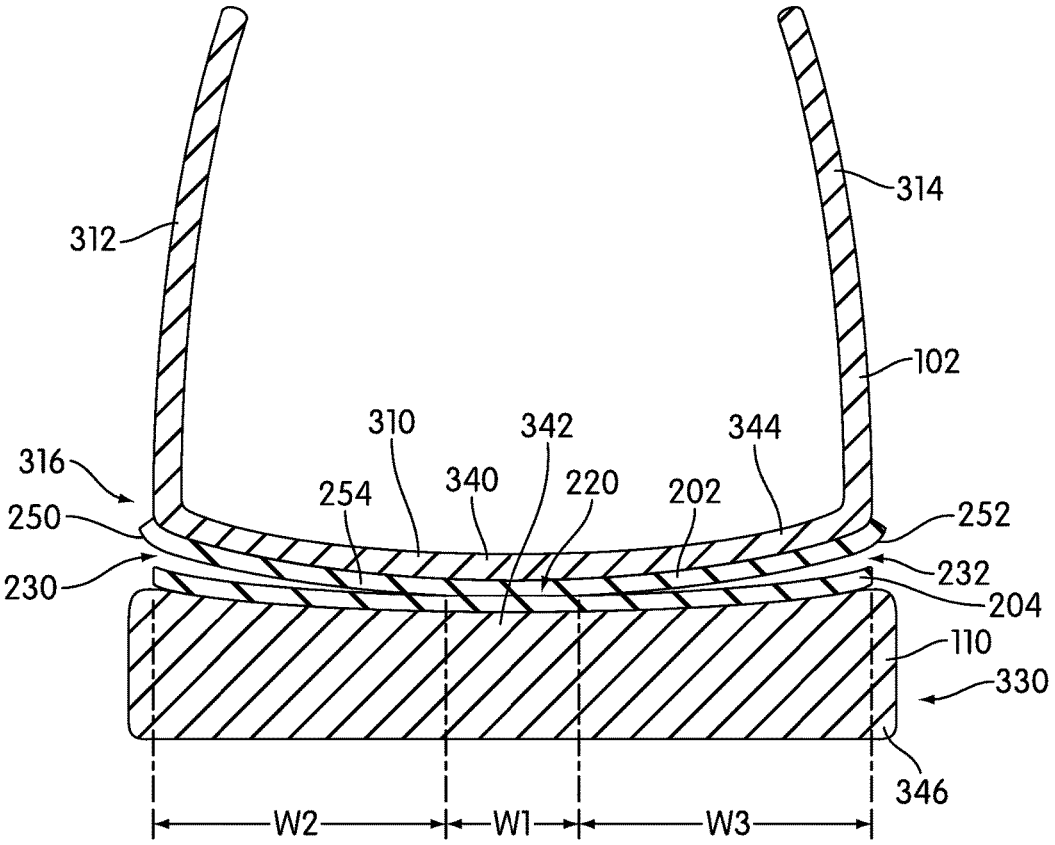
FIG. 4 is a cross-sectional view of an embodiment of an article of footwear.

FIGS. 3 and 4 illustrate cross-sectional views of an embodiment of article 100. In particular, FIG. 3 illustrates an exploded cross-sectional view of article 100, while FIG. 4 illustrates a cross-sectional view of article 100. Referring to FIGS. 3 and 4, upper layer 202 may be associated with upper 102, while lower layer 204 may be associated with sole structure 110. In some cases, upper surface 302 of upper layer 202 may be attached to lower surface 304 of upper 102. In a similar manner, lower surface 306 of lower layer 204 may be attached to upper surface 308 of sole structure 110.

In the current embodiment, upper layer 202 is attached to lower portion 310 of upper 102, as well as to lower periphery 316 of upper 102 that extends between lower portion 310 and first sidewall 312 and second sidewall 314. In particular, first peripheral edge 250 and second peripheral edge 252 of upper layer 202 may be attached to lower periphery 316 of upper 102. Also, intermediate portion 254, which is disposed between first peripheral edge 250 and second peripheral edge 252, may be attached to lower portion 310. In some cases, the width of upper layer 202 can be adjusted so that first peripheral edge 250 and second peripheral edge 252 of upper layer 202 attach to upper 102 higher up on first sidewall 312 and second sidewall 314. Furthermore, first peripheral edge 250 and second peripheral edge 252 may be attached at varying vertical heights along first sidewall 312 and second sidewall 314, respectively.

In one embodiment, lower layer 204 may have a width substantially similar to the width of sole structure 110. In other cases, however, lower layer 204 could have a width that is less than the width of sole structure 110. In still other cases, lower layer 204 may have a width that is greater than the width of sole structure 110 so that portions of lower layer 204 may wrap around sidewalls 330 of sole structure 110.

Upper layer 202 may be attached to various portions of upper 102 in any manner. In some cases, upper layer 202 could be bonded to upper 102 using an adhesive of some kind. In other cases, upper layer 202 could be stitched to upper 102. In still other cases, some portions of upper layer 202 may be attached to upper 102 using an adhesive and other portions of upper layer 202 may be attached to upper 102 using stitching. In a similar manner, lower layer 204 may be attached to various portions of sole structure 110 in any manner. In some cases, lower layer 204 could be bonded to sole structure 110 using an adhesive. In other cases, lower layer 204 may be attached to sole structure in some other manner, such as by the use of fasteners of some kind.

This arrangement provides for a partial decoupling between upper 102 and sole structure 110 as previously discussed. In this case, upper 102 and sole structure 110 are coupled by way of central attachment portion 220 of connecting member 200. In particular, central portion 340 of upper 102 and central portion 342 of sole structure 110 are directly coupled to one another by way of central attachment portion 220. However, outward portions 344 of upper 102 and outward portions 346 of sole structure 110 are attached to first decoupled portion 230 and second decoupled portion 232 and therefore may move partially independently of each other.

An article with a connecting member can include provisions for controlling the amount of decoupling between an upper and a sole structure. In some cases, the size of a central attachment portion and a decoupling portion can be varied to tune the decoupling properties of the article. For example, to achieve a high degree of decoupling, the central attachment portion can have a substantially narrower width than one or more decoupling portions of the connecting member.

In different embodiments, the width of central attachment portion 220 can vary. In this embodiment, central attachment portion 220 has width W1. Similarly, first decoupled portion 230 has width W2 and second decoupled portion 232 has width W3. Generally, the sizes of width W1, width W2 and width W3 can be varied to tune the decoupling properties of connecting member 200. In an exemplary embodiment, width W1 may be substantially less than width W2. In other words, first decoupled portion 230 may be substantially wider than central attachment portion 220. In addition, in some cases, width W1 may be substantially less than width W3. In other words, second decoupled portion 232 may be substantially wider than central attachment portion 220. Moreover, with upper 102 attached to sole structure 110 by way of connecting member 200, a majority of upper 102 and sole structure 110 may be decoupled from each other along portions of article 100 where connecting member 200 is used.

The dimensions for central attachment portion 220 as well as first decoupled portion 230 and second decoupled portion 232 discussed here are only intended to be exemplary. In other embodiments, the widths of central attachment portion 220, first decoupled portion 230 and second decoupled portion 232 may vary in any manner. For example, in another embodiment, central attachment portion 220 could have a width that is substantially greater than the widths of either first decoupled portion 230 and second decoupled portion 232. In another embodiment, central attachment portion 220 may have a substantially similar width to first decoupled portion 230 and/or second decoupled portion 232. Furthermore, while the current embodiment illustrates first decoupled portion 230 and second decoupled portion 232 with approximately equal widths, in other embodiments first decoupled portion 230 and second decoupled portion 232 could have substantially different widths. For example, in another embodiment, first decoupled portion 230 could be substantially wider than second decoupled portion 232 which may provide for a greater amount of decoupling on lateral side 16 than medial side 18.

It should also be understood that in different embodiments, the geometry and/or size of central attachment portion 220 can be varied. In the current embodiment, central attachment portion 220 has the shape of a relatively narrow longitudinal strip with a substantially constant width. In other embodiments, however, the shape of central attachment portion 220 could be varied and in some cases central attachment portion 220 could be provided with a width that varies along the length of connecting member 200.

In some cases, width W1 of central attachment portion 220 could have a value that approximately varies between 1% and 10% of the total width of connecting member 200. In other cases, width W1 could have a value that approximately varies between 10% and 50% of the total width of connecting member 200. In still other cases, width W1 could have a value that approximately varies between 50% and 99% of the total width of connecting member 200.

Figure 5:
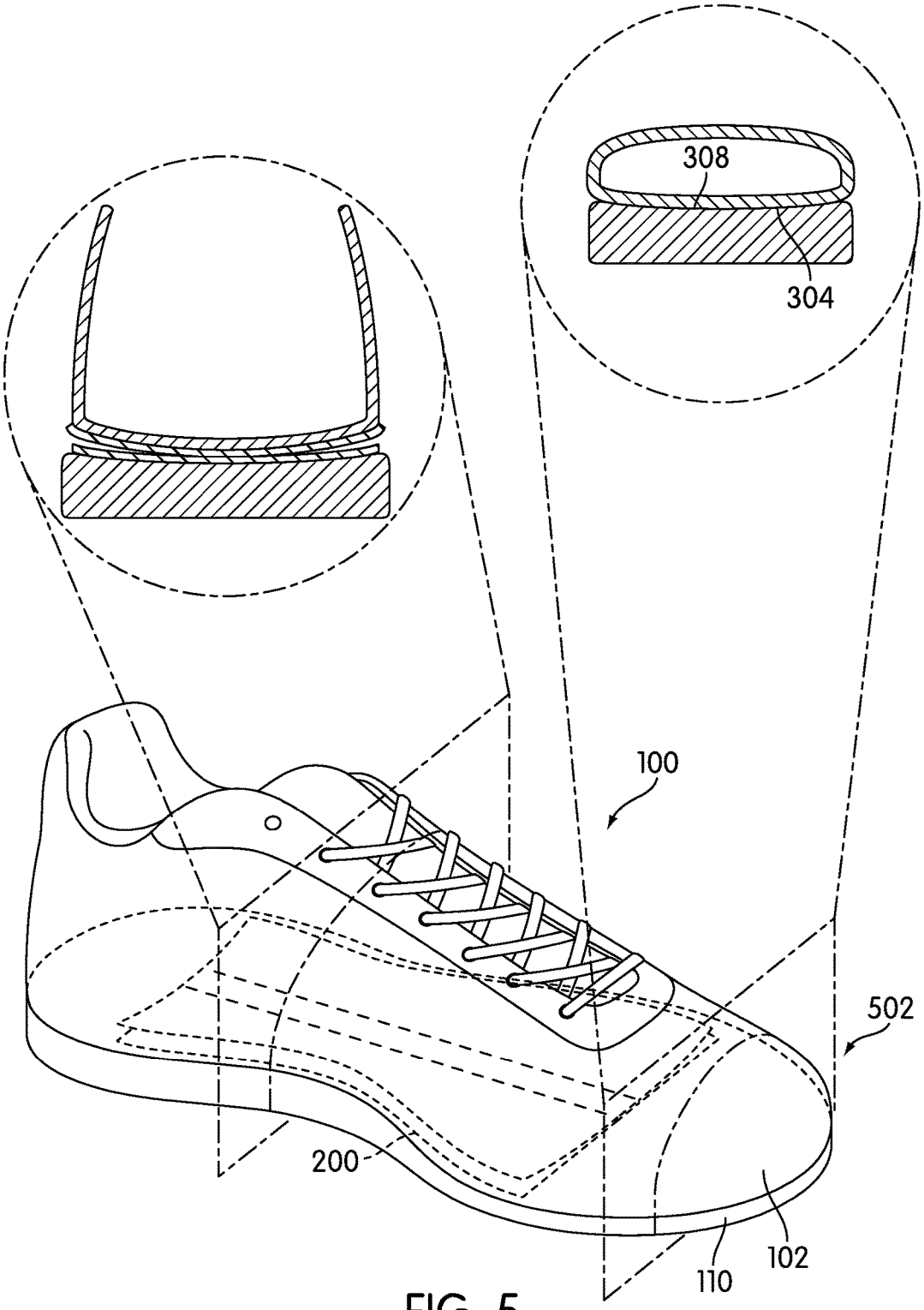
FIG. 5 is an isometric view of an embodiment of an article of footwear.

FIG. 5 illustrates an isometric view of an embodiment of article 100 with connecting member 200 shown in phantom. Referring to FIG. 5, upper 102 and sole structure 110 can be attached in different ways at different locations of article 100. In the current embodiment, upper 102 and sole structure 110 may be partially decoupled at midfoot portion 12, as well as some portions of forefoot portion 10 and heel portion 14. In this case, upper 102 and sole structure 110 are partially decoupled in regions where connecting member 200 is present. In contrast, portions of upper 102 and sole structure 110 not associated with connecting member 200 may be completely coupled. For example, in this embodiment, toe portion 502 of article 100 is a portion where upper 102 and sole structure 110 are completely coupled. Specifically, lower surface 304 of upper 102 is directly in contact with upper surface 308 of sole structure 110. Furthermore, lower surface 304 of upper 102 and upper surface 308 of sole structure 110 are fixedly attached across a substantial entirety of the width of article 100 at toe portion 502.

This arrangement provides for different amounts of coupling between upper 102 and sole structure 110 along different portions of article 100. By adjusting the length of connecting member 200, the portions of upper 102 and sole structure 110 that are partially decoupled can be varied. Likewise, as the length of connecting member 200 is varied, the portions of article 100 that are fully coupled can be varied. For example, in an embodiment using a full length connecting member that extends through the entire length of an article, all portions of upper 102 and sole structure 110 could be partially decoupled. In another example, a connecting member could be disposed only in a forefoot portion of an article to limit the regions of partial decoupling between an upper and a sole structure to the forefoot portion.

Figure 6:
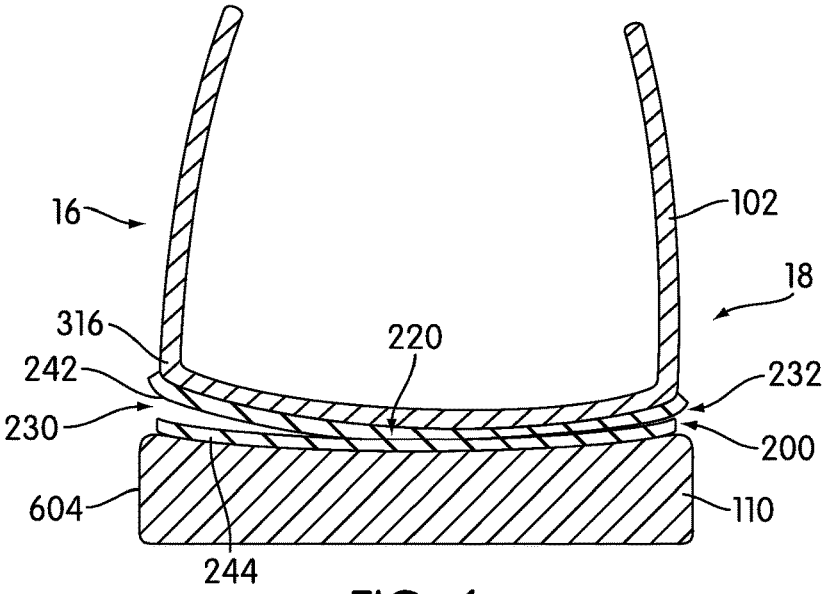
FIG. 6 is a cross-sectional view of an embodiment of an article of footwear.
Figure 7:
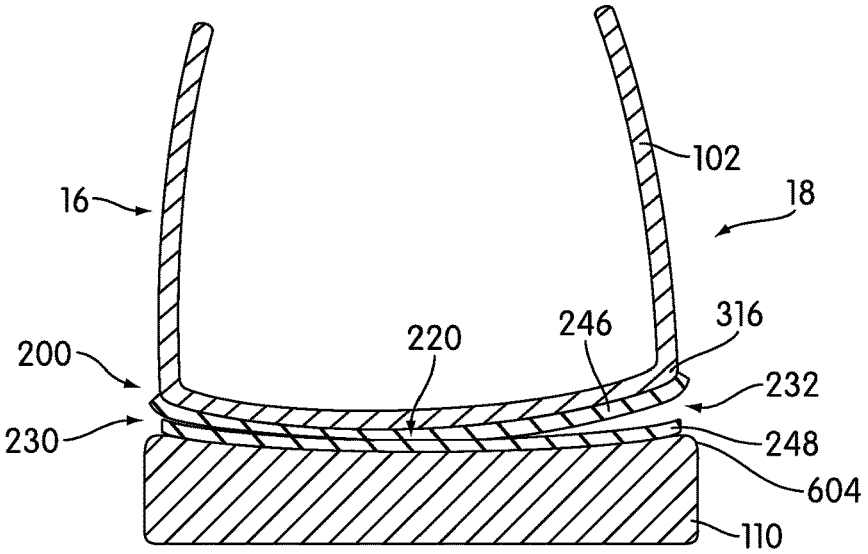
FIG. 7 is a cross-sectional view of an embodiment of an article of footwear.

FIGS. 6 and 7 are cross-sectional views of an embodiment of article 100. Referring to FIGS. 6 and 7, connecting member 200 provides partial decoupling between upper 102 and sole structure 110 that allows upper 102 to lean or tilt with respect to sole structure 110. As upper 102 tilts towards medial side 18 (seen in FIG. 6), first decoupled portion 230 may open. In particular, first free portion 242 of upper layer 202 and first free portion 244 of lower layer 204 may separate to allow lower periphery 316 of upper 102 and upper periphery 604 of sole structure 110 to move away from one another on lateral side 16. This configuration allows upper 102 to roll to medial side 18. In addition, second decoupled portion 232 closes and is compressed as forces are transferred to medial side 18. Therefore, forces are absorbed by connecting member 200. Also, upper 102 and sole structure 110 are permitted to partially decouple to improve stability for a user.

In a similar manner, as upper 102 tilts towards lateral side 16 (seen in FIG. 7), second decoupled portion 232 may open. In particular, second free portion 246 of upper layer 202 and second free portion 248 of lower layer 204 separate to allow lower periphery 316 of upper 102 and upper periphery 604 of sole structure 110 to move away from one another on medial side 18. This configuration allows upper 102 to roll to lateral side 16. In addition, first decoupled portion 230 closes and is compressed as forces are transferred to lateral side 16. Therefore, forces are absorbed by connecting member 200. Also, upper 102 and sole structure 110 are permitted to partially decouple to improve stability for a user.

Connecting member 200 can provide means of adjusting the width of an upper to accommodate feet of differing sizes. In some cases, an upper can be partially decoupled from a sole structure in order to conform to the size of an inserted foot for improving fit and comfort of an article.

Figure 8:
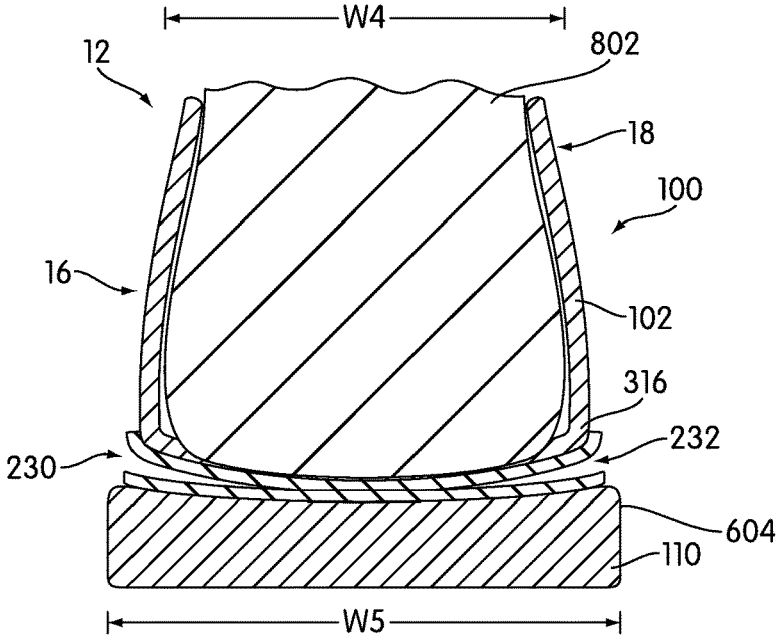
FIG. 8 is a cross-sectional view of an embodiment of an article of footwear.
Figure 9:
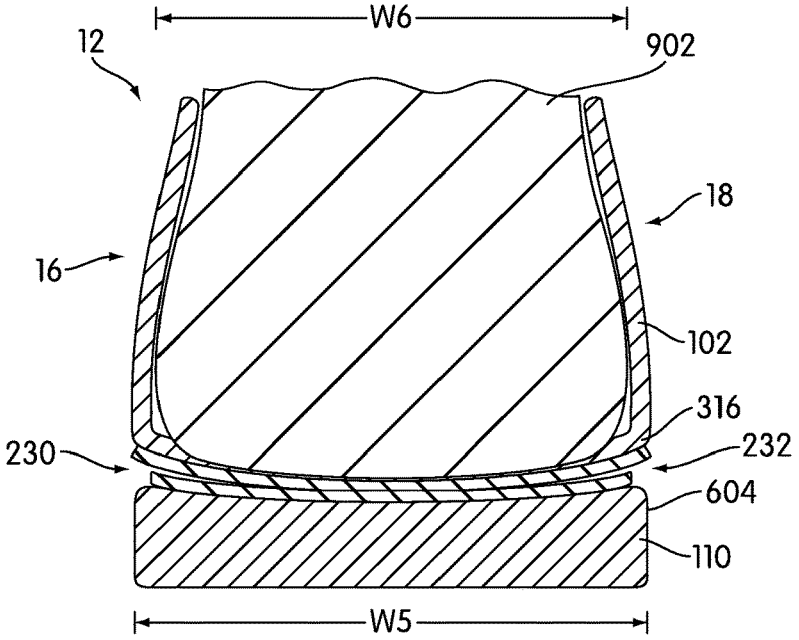
FIG. 9 is a cross-sectional view of an embodiment of an article of footwear.

Referring now to FIGS. 8 and 9, article 100 may adjust to various foot widths, especially at midfoot portion 12 where the width of a foot may vary the most for substantially similar foot sizes. In a first position, shown in FIG. 8, upper 102 may have a width W4 that conforms to the width of first foot 802. In particular, with the laces of article 100 tightened, lateral side 16 and medial side 18 of upper 102 are drawn relatively close together. In this position, width W4 may be substantially less than width W5 of sole structure 110. In other words, lower periphery 316 of upper 102 is disposed substantially inwardly of upper periphery 604 of sole structure 110. This can happen since lower periphery 316 and upper periphery 604 are not directly coupled, but are instead partially decoupled through first decoupled portion 230 and second decoupled portion 232.

In a second position, shown in FIG. 9, upper 102 may have width W6 that conforms to the width of second foot 902. In this case, width W6 is substantially larger than width W4 since second foot 902 is substantially wider than first foot 802. In particular, with the laces of article 100 tightened, lateral side 16 and medial side 18 of upper 102 are pushed further apart to accommodate the larger width of second foot 902. In this position, width W6 may be substantially larger than width W5 of sole structure 110. In other words, lower periphery 316 of upper 102 is disposed substantially outwardly of upper periphery 604 of sole structure 110. Moreover, in this second position, the amount of upper 102 disposed beneath second foot 902 is increased from the amount of upper 102 disposed beneath first foot 802. This can happen since lower periphery 316 and upper periphery 604 are not directly coupled, but are instead partially decoupled through first decoupled portion 230 and second decoupled portion 232.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. In addition, an upper can be made from any suitable material including, but not limited to: natural leather, synthetic leather, fabric (including woven and nonwoven fabrics) as well as any other materials known in the art for constructing uppers. Furthermore, a connecting member may be made of any material having the properties discussed above. In some cases, a connecting member can be made of a material that is configured to a substantially flexible material. In other cases, a connecting member can be made of a material that is configured to compress and provide shock absorption. In an exemplary embodiment, a connecting member can be made of any suitable elastomeric material.

As previously discussed, the length of connecting member 200 can vary. By varying the length of connecting member 200, different portions of upper 102 and sole structure 110 can be coupled in a variety of ways. In particular, upper 102 and sole structure 110 may be partially coupled at those portions that are connected together by connecting member 200, and totally coupled elsewhere.

Figure 10:
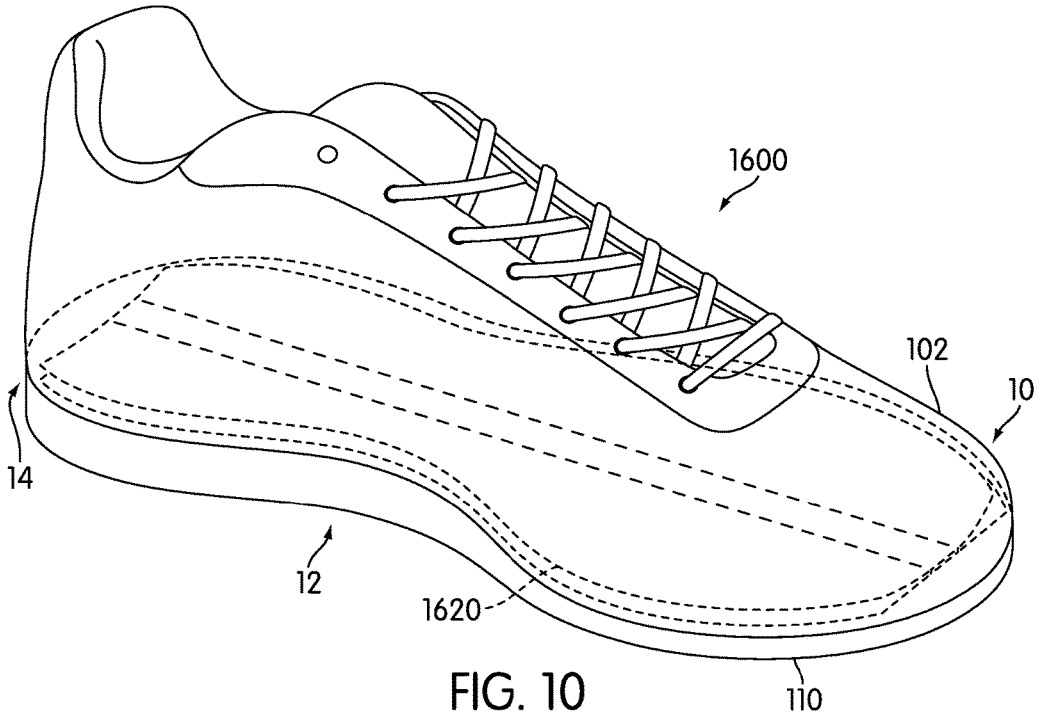
FIG. 10 is an isometric view of an embodiment of an article of footwear with a full length connecting member.
Figure 11:
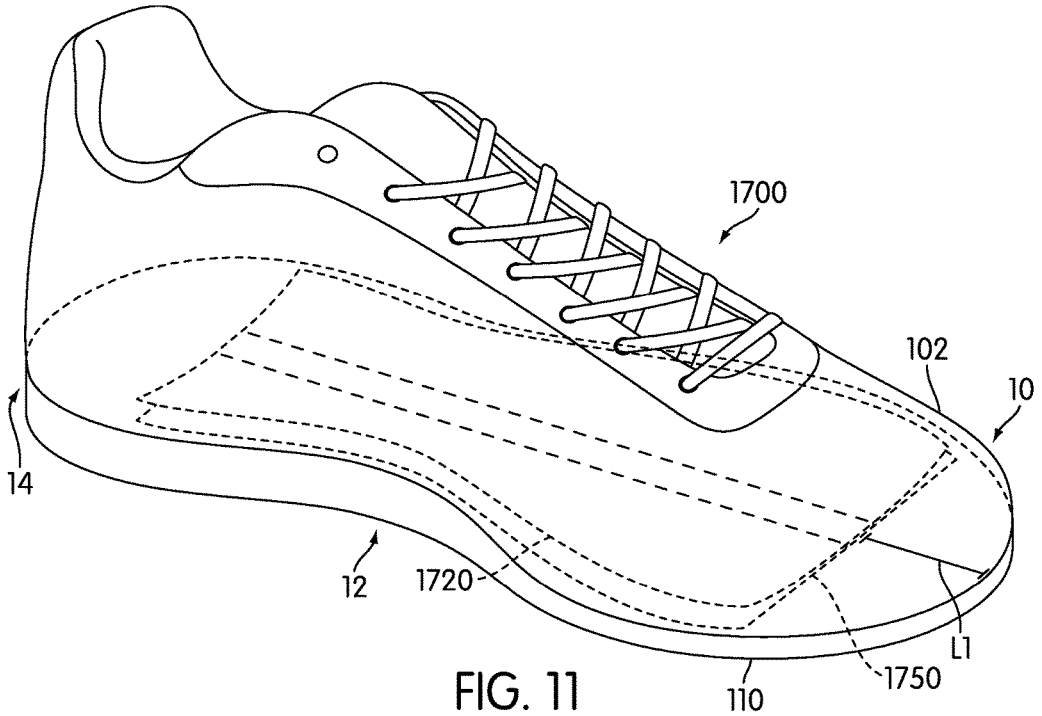
FIG. 11 is an isometric view of an embodiment of an article of footwear with a connecting member extending through a forefoot portion of the article.
Figure 12:
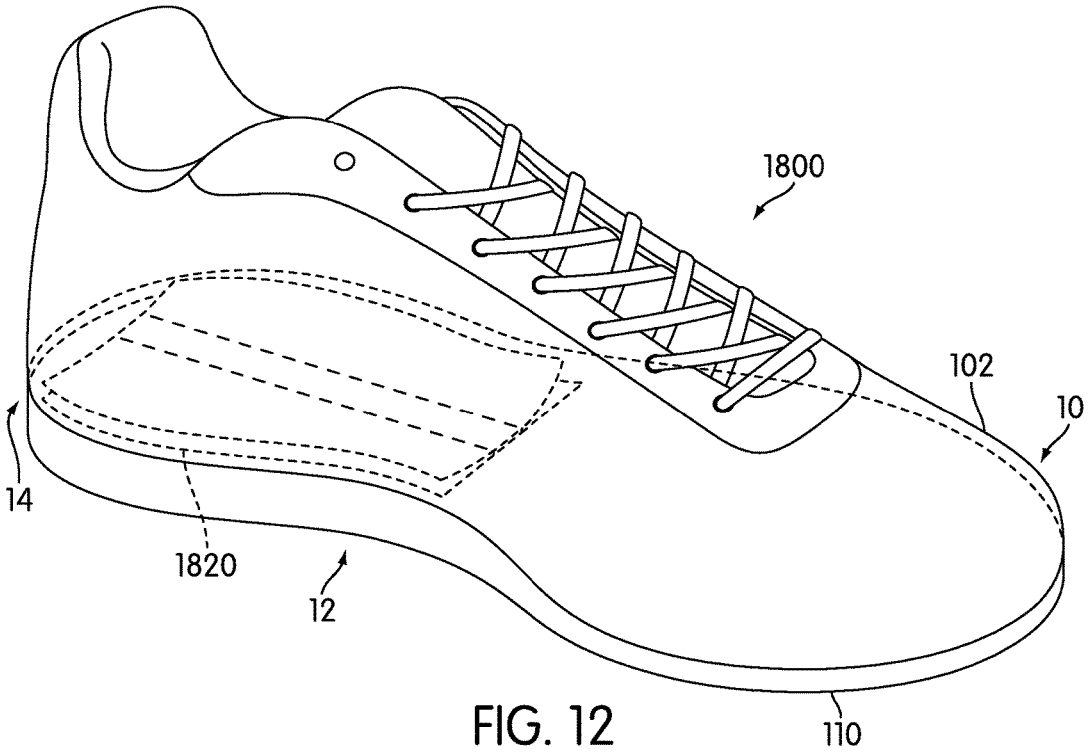
FIG. 12 is an isometric view of an embodiment of an article of footwear with a connecting member extending through a heel portion of the article.

FIGS. 10 through 12 illustrate alternative embodiments for an article of footwear with connecting members of varying lengths and positions. Referring to FIGS. 10 through 12, each article of footwear can include upper 102 and sole structure 110 as discussed for article of footwear 100. In addition, identical numbers are used to identify substantially identical components discussed previously for article of footwear 100. Furthermore, the connecting members discussed in these Figures may have substantially similar properties to connecting member 200 and may differ primarily in length and location.

Referring now to FIG. 10, article of footwear 1600, hereby simply referred to as article 1600, includes connecting member 1620, which is a full length connecting member. In particular, connecting member 1620 extends throughout the substantial entirety of forefoot portion 10, midfoot portion 12 and heel portion 14. In some cases, connecting member 1620 may not extend into the forward most portion of forefoot portion 10. Likewise, in some cases, connecting member 1620 may not extend into the rearward most portion of heel portion 14. In other cases, however, connecting member 1620 may extend throughout the entirety of the length of article 1600 so that no portions of upper 102 and sole structure 110 are completely coupled. Using this arrangement, a substantial majority of article 1600 may be partially decoupled to provide for enhanced fit and stability over the entirety of article 1600.

Referring now to FIG. 11, article of footwear 1700, hereby simply referred to as article 1700, includes connecting member 1720. In this case, connecting member 1720 extends further into forefoot portion 10 than connecting member 1620 of the previous embodiment. In other words, connecting member 1720 is a bit longer in the front portion of article 1700. In this case, connecting member 1720 may be spaced apart from forward edge 1750 of article 1700 by length L1. In different embodiments, the value of length L1 could vary. In some cases, length L1 could have a value approximately in the range between 0.1 and 2 inches. In an exemplary embodiment, length L1 could have a value of approximately 1 inch. This arrangement may provide for additional decoupling in forefoot portion 10 to help improve the fit of article 1700 at forefoot portion 10.

Referring now to FIG. 12, article of footwear 1800 includes connecting member 1820. In this case, connecting member 1820 is disposed primarily within heel portion 14 of article 1800. Some portions of connecting member 1820 also extend into midfoot portion 12, or the arch of article 1800. This arrangement may provide for enhanced decoupling at heel portion 14. Using the arrangement, article 1800 may provide an enhanced fit for the heel of a foot and can help assist in stability at heel portion 14.

An article can include provisions for decoupling an upper and sole structure on only a medial or lateral side of the article. In some cases, a connecting component may be configured to decouple an article on a lateral side. In other cases, a connecting component may be configured to decouple an article on a medial side.

Figure 13:
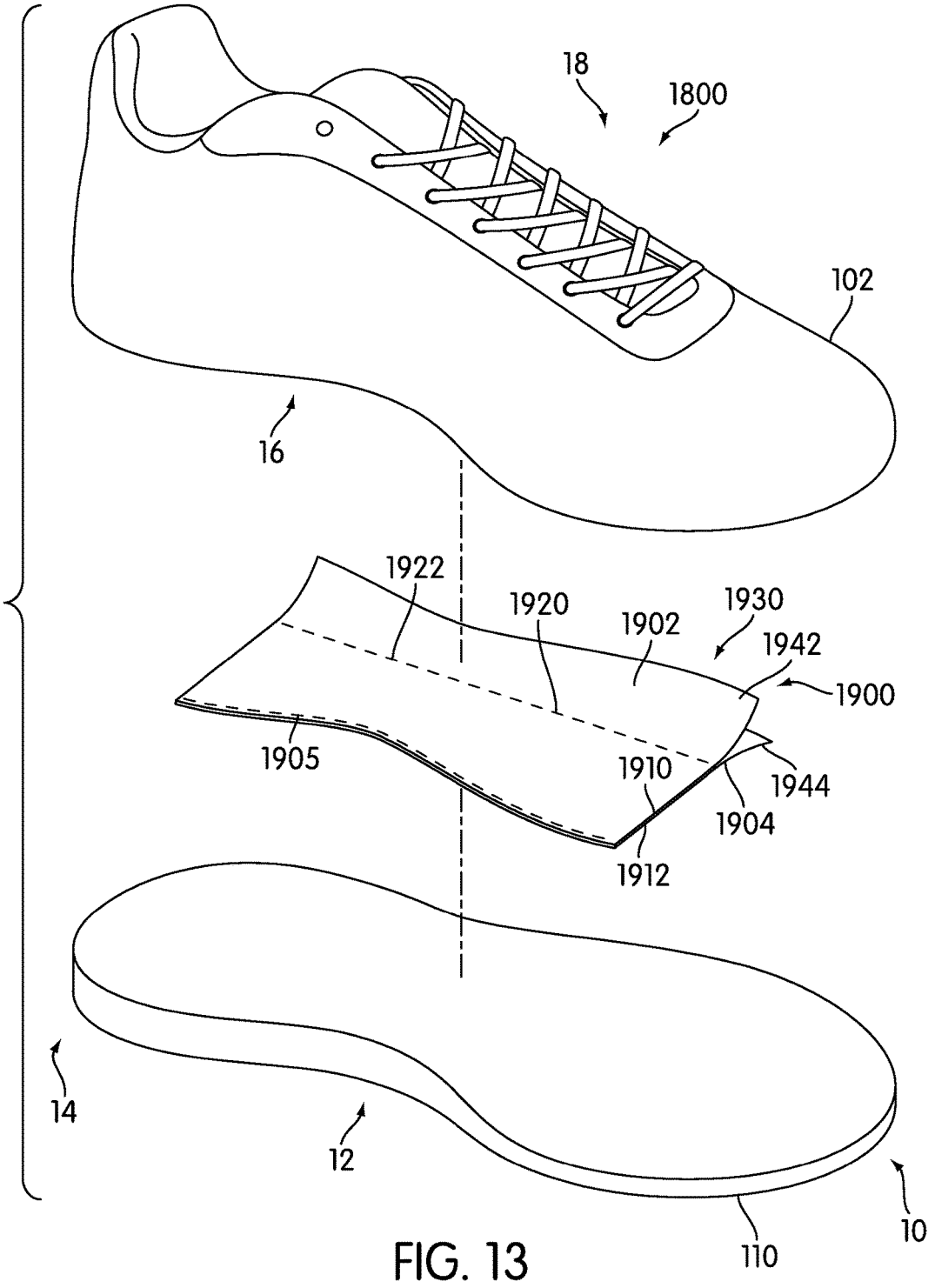
FIG. 13 is an exploded isometric view of an embodiment of an article with a connecting member including one decoupled portion.
Figure 14:
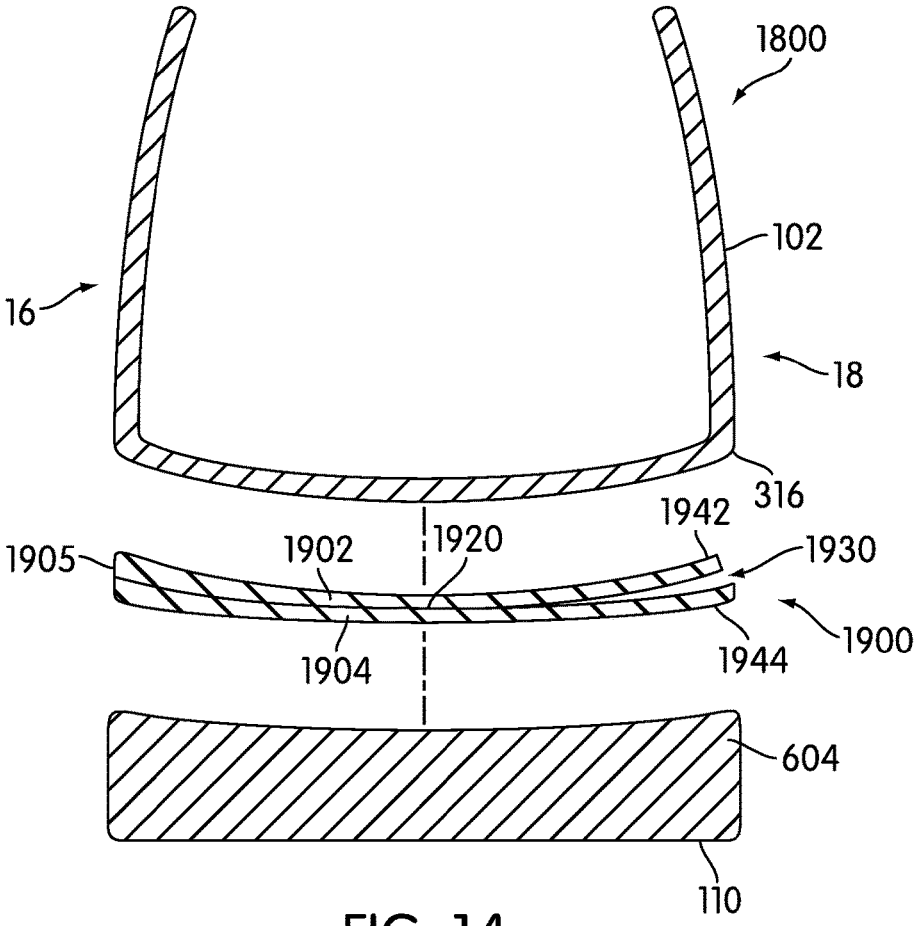
FIG. 14 is an exploded cross sectional view of an embodiment of an article with a connecting member.

FIGS. 13 through 18 are intended to illustrate an embodiment of an article that is decoupled only on a medial side. Referring to FIGS. 13 through 14, article of footwear 1800, hereby referred to simply as article 1800, is provided with upper 102 and sole structure 110 in a similar manner to article 100. Article 1800 can also include connecting member 1900.

Connecting member 1900 may generally be disposed between upper 102 and sole structure 110 and may be used for connecting portions of upper 102 to portions of sole structure 110. In particular, the current embodiment illustrates connecting member 1900 being generally disposed between upper 102 and sole structure 110 at midfoot portion 12 of article 1800, as well as some portions of forefoot portion 10 and heel portion 14.

In some embodiments, connecting member 1900 may further comprise a layered structure. In some cases, connecting member 1900 may comprise two layers. In other cases, connecting member 1900 may comprise more than two layers. In one embodiment, connecting member 1900 may comprise upper layer 1902 and lower layer 1904.

Generally, the geometries of upper layer 1902 and lower layer 1904 can vary. In some cases, upper layer 1902 and lower layer 1904 may have substantially planar geometries such that the thickness of each layer is substantially less than the associated lengths and widths of each layer. In addition, in some cases, upper periphery 1910 of upper layer 1902 and lower periphery 1912 of lower layer 1904 may be contoured in a manner to correspond to the contouring of upper 102 and sole structure 110.

Upper layer 1902 and lower layer 1904 may be joined at central attachment portion 1920. In particular, central attachment portion 1920 is a substantially narrow portion that extends longitudinally through connecting member 1900. In addition, upper layer 1902 and lower layer 1904 may be joined at lateral portion 1905 of connecting member 1900.

Upper layer 1902 and lower layer 1904 can be attached using any means known in the art. In some cases, upper layer 1902 could be attached to lower layer 1904 by stitching. In other cases, upper layer 1902 could be attached to lower layer 1904 using an adhesive of some kind. It will be understood that the method of attaching upper layer 1902 to lower layer 1904 can be selected according to the material properties of upper layer 1902 and lower layer 1904, as well as desired structural properties for connecting member 1900. In an exemplary embodiment, upper layer 1902 may be attached to lower layer 1904 using stitching 1922. Moreover, in some cases, upper layer 1902 and lower layer 1904 may be attached using an adhesive of some kind in the region between central attachment portion 1920 and lateral portion 1905. In other cases, upper layer 1902 and lower layer 1904 may not be attached in the region between central attachment portion 1920 and lateral portion 1905.

Connecting member 1900 may comprise one or more decoupled portions. In the current embodiment, connecting member 1900 includes decoupled portion 1930. Decoupled portion 1930 extends generally from central attachment portion 1920 to medial side 18 of connecting member 1900. Moreover, decoupled portion 1930 includes free portion 1942 of upper layer 1902 and free portion 1944 of lower layer 1904. With this arrangement, free portion 1942 of upper layer 1902 may be configured to move substantially independently of free portion 1944 of lower layer 1904. In contrast to the embodiment discussed previously, connecting member 1900 is not decoupled on lateral side 16. This arrangement provides decoupling between upper 102 and sole structure 110 on medial side 18, and prevents decoupling between upper 102 and sole structure 110 on lateral side 16.

Figure 15:
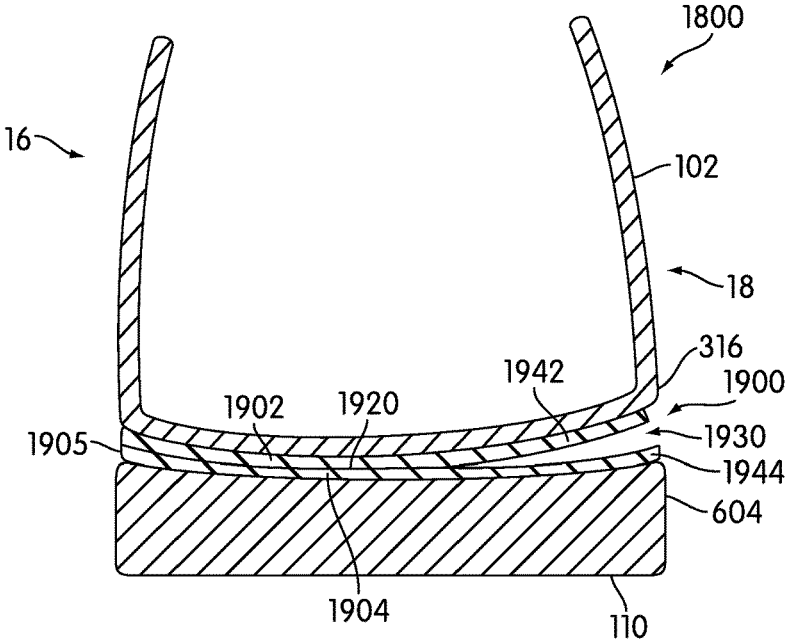
FIG. 15 is a cross sectional view of an embodiment of an article leaning towards a lateral side.

As seen in FIG. 15, as upper 102 tilts towards lateral side 16, decoupled portion 1930 may open. In particular, free portion 1942 of upper layer 1902 and free portion 1944 of lower layer 1904 separate to allow lower periphery 316 of upper 102 and upper periphery 604 of sole structure 110 to move away from one another on medial side 18. This configuration allows upper 102 to roll to lateral side 16. Therefore, forces are absorbed by connecting member 1900. Also, upper 102 and sole structure 110 are permitted to partially decouple to improve stability for a user.

Figure 16:
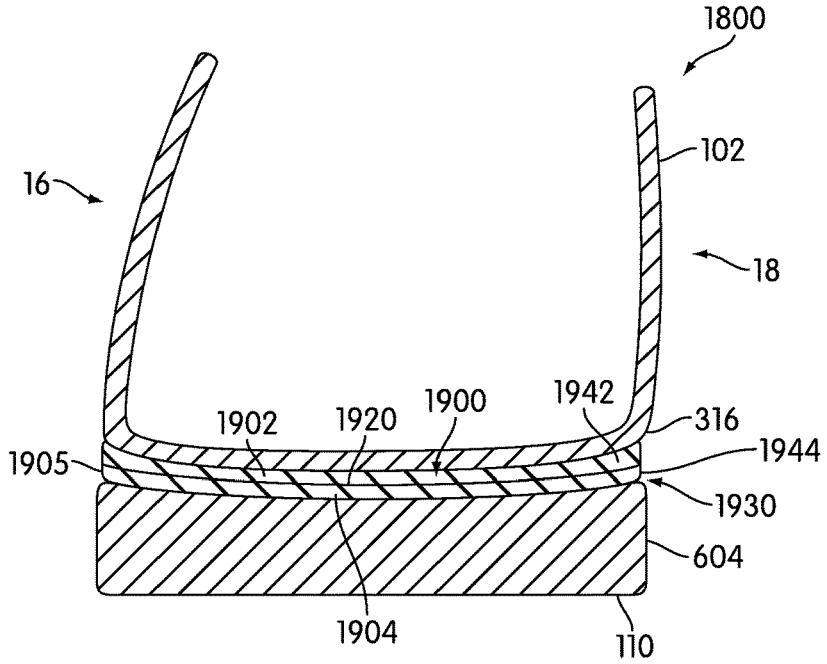
FIG. 16 is a cross sectional view of an embodiment of an article leaning towards a medial side.

However, as seen in FIG. 16, as upper 102 tilts towards medial side 18, no decoupling occurs on lateral side 18. Instead, lower periphery 316 of upper 102 and upper periphery 604 of sole structure 110 are completely coupled at lateral side 18 since upper layer 1902 and lower layer 1904 are connected at lateral side 18. Therefore, in some cases article 1800 behaves similar to a traditional type of footwear that is fully coupled under medial rolling.

Figure 17:
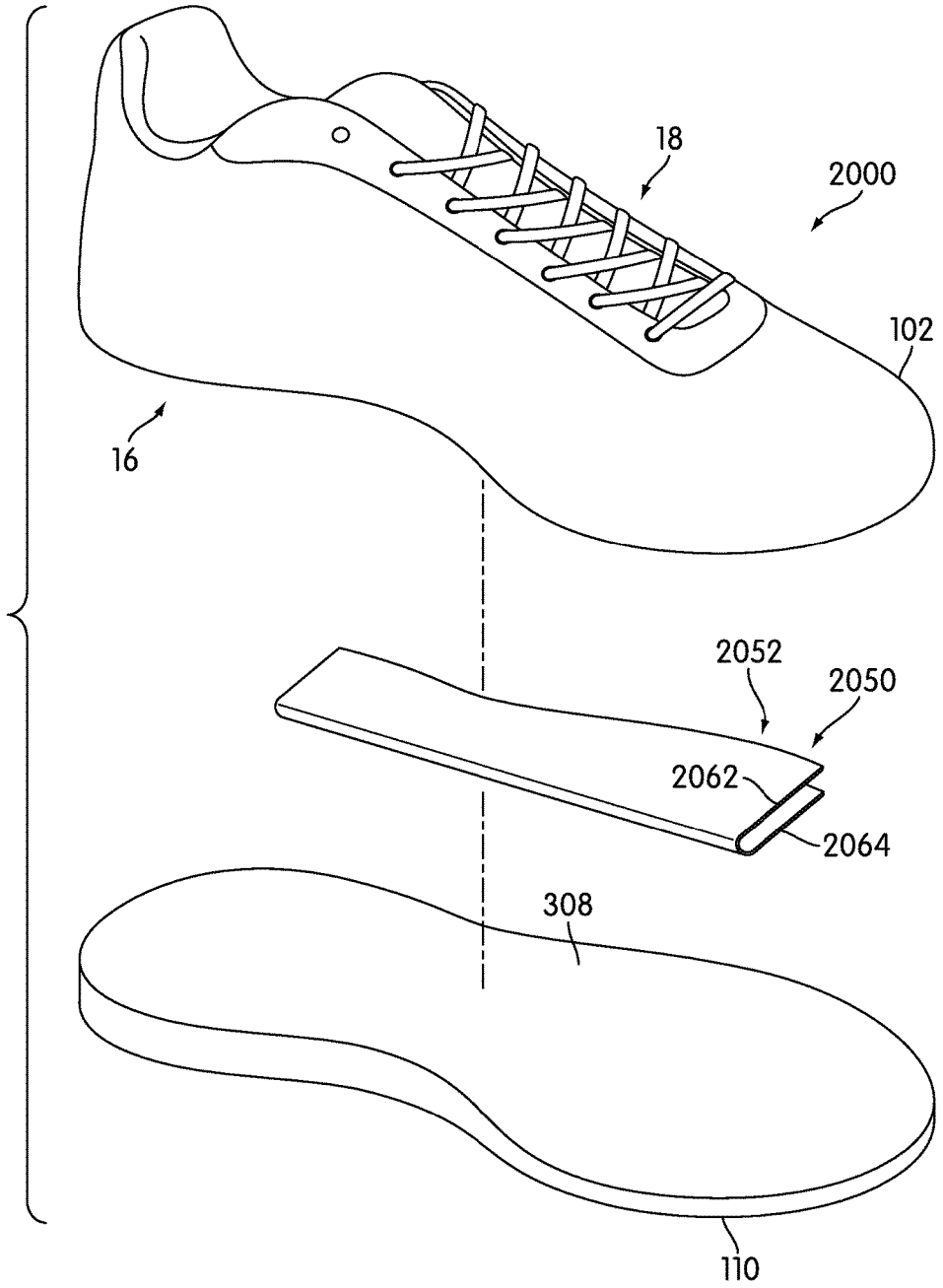
FIG. 17 is an exploded cross sectional view of an embodiment of an article with a connecting member comprising a folded layer.
Figure 18:
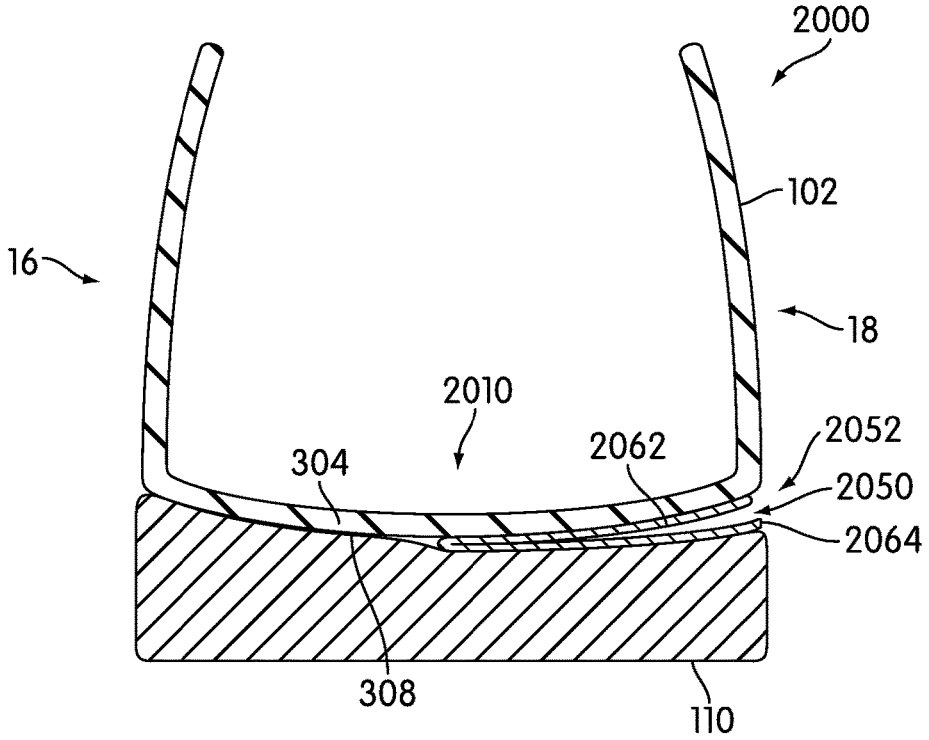
FIG. 18 is a cross sectional view of an embodiment of an article with a connecting member comprising a folded layer.

FIGS. 17 and 18 illustrate an alternative embodiment of a method of decoupling an upper on one side. Referring to FIGS. 17 and 18, article of footwear 2000 includes upper 102 and sole structure 110 in a similar manner to the previous embodiments. Article 2000 is also provided with connecting member 2050 that is disposed on medial side 18 of article 2000.

In this embodiment, connecting member 2050 is provided as a single layer of material that is folded in half to provide decoupled portion 2052. Decoupled portion 2052 includes first free portion 2062 and second free portion 2064 that connect to upper 102 and sole structure 110, respectively. Moreover, in the current embodiment, upper 102 and sole structure 110 may be attached directly to one another on lateral side 16 of article 2000. In particular, lower surface 304 of upper 102 and upper surface 308 of sole structure 110 are directly connected between central portion 2010 of article 2000 and lateral side 16.

Using this arrangement, upper 102 and sole structure 110 may be partially decoupled at medial side 18. This allows the width of article 2000 to be partially adjusted on medial side 18. Furthermore, this may enhance stability on medial side 18.

Although the current embodiments illustrate partial decoupling of an article of footwear on a medial side, in other embodiments, connecting members could be configured to provide partial decoupling on a lateral side of an article. For example, in another embodiment, connecting member 2050 could be used on lateral side 16 of article 2000 to provide partial decoupling on lateral side 16, rather than medial side 18.

An article with a connecting member can include provisions for covering the decoupled portions of an upper and sole structure. In some cases, an article can include one or more covering portions that cover openings that may form between the upper and sole structure during use. This arrangement may help prevent debris from entering the regions between the upper and sole structure that are partially decoupled.

Figure 19:
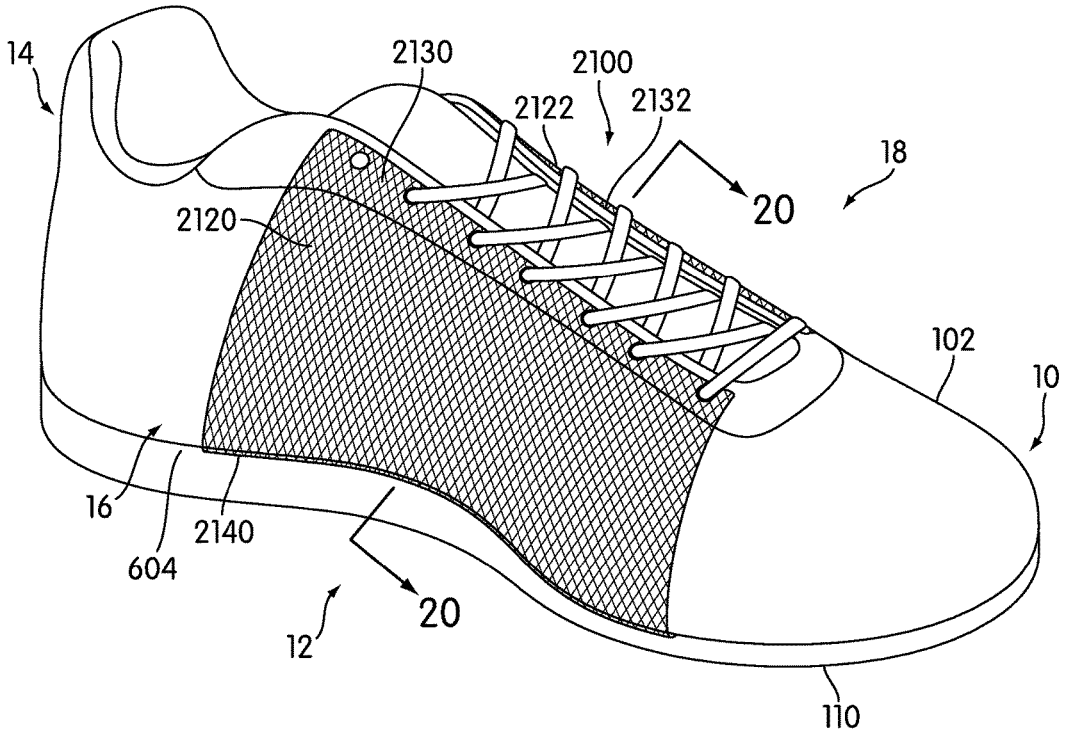
FIG. 19 is an isometric view of an embodiment of an article of footwear including a covering portion.
Figure 20:
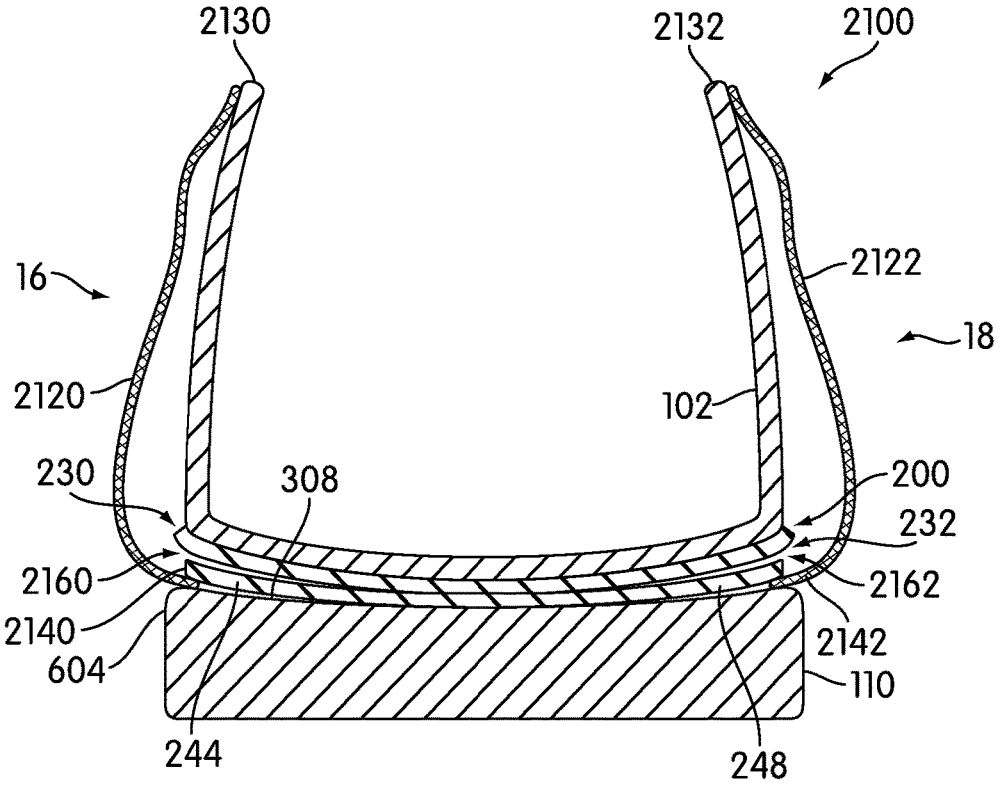
FIG. 20 is a cross sectional view of an embodiment of an article of footwear including a covering portion.

Referring to FIGS. 19 and 20, article of footwear 2100, hereby referred to simply as article 2100, is provided with upper 102 and sole structure 110. In addition, article of footwear 2100 is also provided with connecting member 200. As previously discussed, connecting member 200 may provide partial decoupling between upper 102 and sole structure 110.

Article 2100 may also include one or more covering portions. In the current embodiment, article 2100 may include first covering portion 2120 and second covering portion 2122, which are disposed on lateral side 16 and medial side 18, respectively, of article 2100. First covering portion 2120 is generally disposed over lateral side 16 of upper 102. Moreover, first covering portion 2120 extends throughout midfoot portion 12 of article 2100, as well as portions of heel portion 14 and forefoot portion 10. In an exemplary embodiment, the length of first covering portion 2120 may be substantially similar to the length of connecting member 200. Furthermore, covering portion 2120 may be substantially aligned with connecting member 200 in the longitudinal direction. In a similar manner, second covering portion 2122 may be disposed over medial side 18 of upper 102. In addition, second covering portion 2122 may have a substantially similar length to connecting member 200. Also, second covering portion 2122 may be generally aligned with connecting member 200 in the longitudinal direction.

First covering portion 2120 may extend from lateral lacing edge 2130 to sole structure 110. In some cases, lower edge 2140 of first covering portion 2120 may be connected to upper periphery 604 of sole structure 110. In the current embodiment, lower edge 2140 of first covering portion 2120 may be attached between upper surface 308 of sole structure 110 and first free portion 244 of lower layer 204. In a similar manner, second covering portion 2122 may extend from medial lacing edge 2132 to sole structure 110. In some cases, lower edge 2142 of second covering portion 2122 may be connected to upper periphery 604 of sole structure 110. In the current embodiment, lower edge 2142 of second covering portion 2122 may be attached between upper surface 308 of sole structure 110 and second free portion 248 of lower layer 204.

With this arrangement, first covering portion 2120 may cover first opening 2160 that is associated with first decoupled portion 230. Likewise, second covering portion 2122 may cover second opening 2162 that is associated with second decoupled portion 232. This configuration may help to prevent debris from entering first opening 2160 and second opening 2162 as upper 102 and sole structure 110 are decoupled during use of article 2100.

Figure 21:
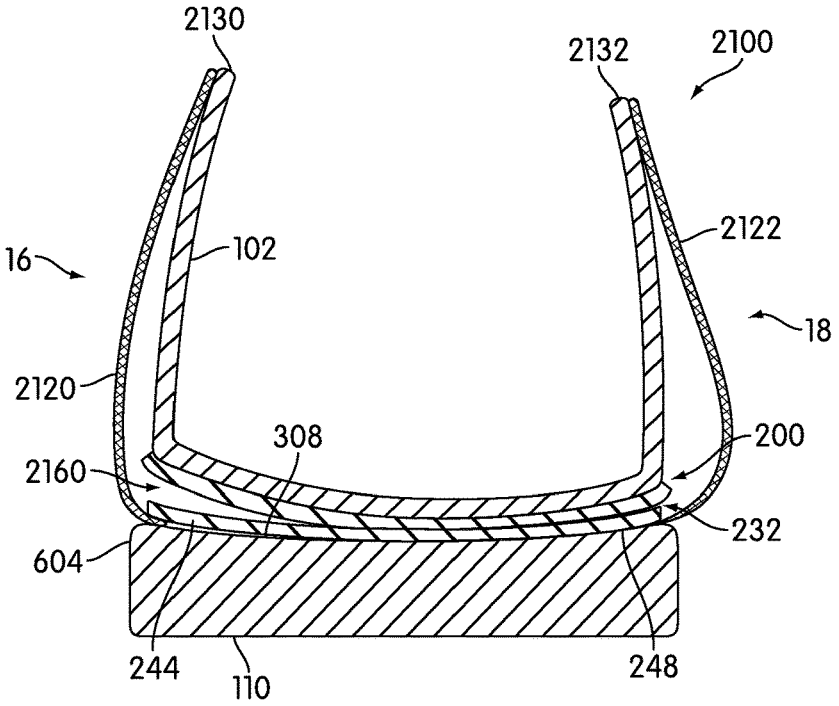
FIG. 21 is a cross sectional view of an embodiment of an article leaning towards a medial side.

Referring to FIG. 21, as upper 102 rolls towards medial side 18, first opening 2160 may expand. However, in this situation, first covering portion 2120 helps to prevent any debris from entering first opening 2160. In a similar manner, in situations where upper 102 rolls towards lateral side 16, second covering portion 2122 may help to prevent any debris from entering second opening 2162.

Generally, covering portions could be made of any materials having any material properties. Examples of different materials that may be used include, but are not limited to: natural leathers, synthetic leathers, natural fibers, synthetic fibers, composite materials, as well as any other materials. In some cases, one or more covering portions may comprise substantially elastic materials. By using substantially elastic materials, covering portions can conform to the sides of an upper during use and may expand and contract as the upper tilts with respect to the sole structure.

In the current embodiment, first covering portion 2120 and second covering portion 2122 may comprise a substantially elastic mesh. Using a mesh material may enhance flexibility of first covering portion 2120 and second covering portion 2122. As seen in FIG. 21, as upper 102 tilts, first covering portion 2120 may be pulled taught, while second covering portion 2122 may loosen. Moreover, the mesh material may be a breathable mesh that allows for air to flow through first covering portion 2120 and second covering portion 2122.

Figure 22:
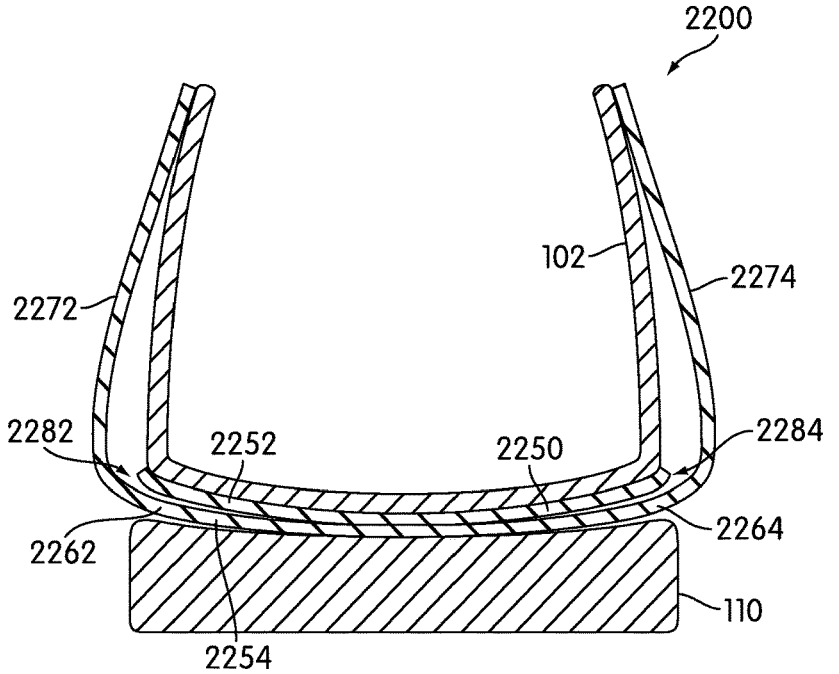
FIG. 22 is a cross sectional view of an embodiment of an article in which a covering portion is associated with a connecting member.

In some embodiments, one or more covering portions could be integrally formed with a connecting member. Referring now to FIG. 22, a cross sectional view of an alternative embodiment for an article is shown. In this case, article 2200 includes upper 102 and sole structure 110. Moreover, article 2200 includes connecting member 2250. Connecting member 2250 includes upper layer 2252 and lower layer 2254. Connecting member 2250 also includes first covering portion 2272 and second covering portion 2274 that are integrally formed with connecting member 2250. In particular, first covering portion 2272 is integrally formed with first free portion 2262 of lower layer 2254, while second covering portion 2274 is integrally formed with second free portion 2264 of lower layer 2254. In other words, connecting member 2250 serves to partially decouple upper 102 and sole structure 110 and also provides covering for first opening 2282 and second opening 2284.

Figure 23:
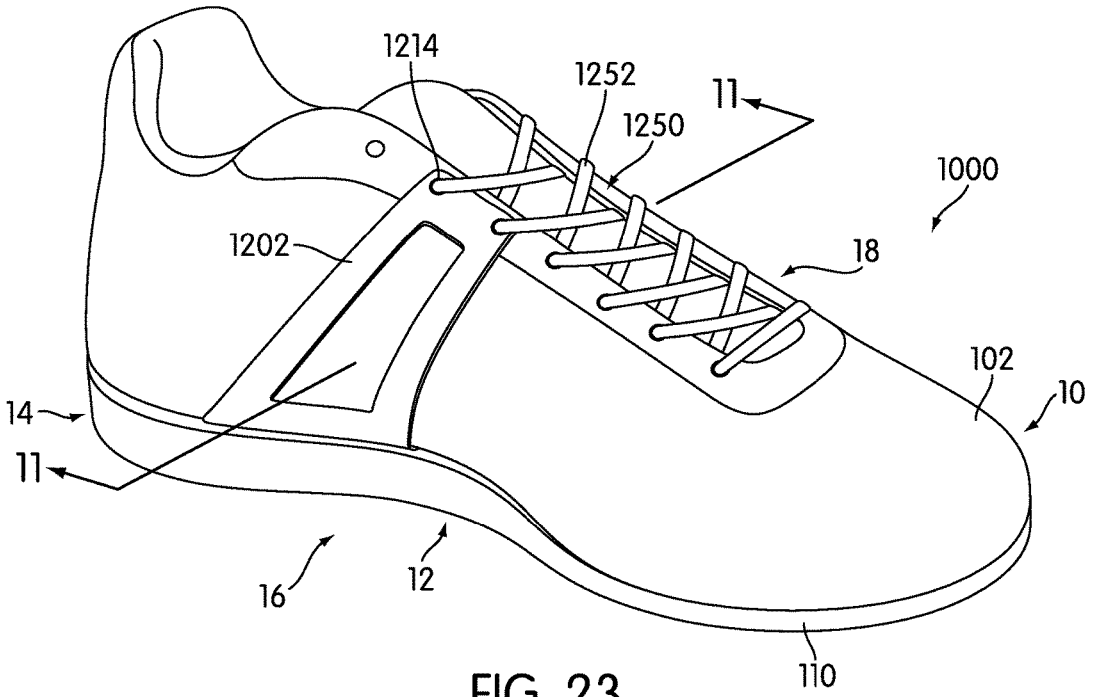
FIG. 23 is an isometric view of an embodiment of an article of footwear including a strap.
Figure 24:
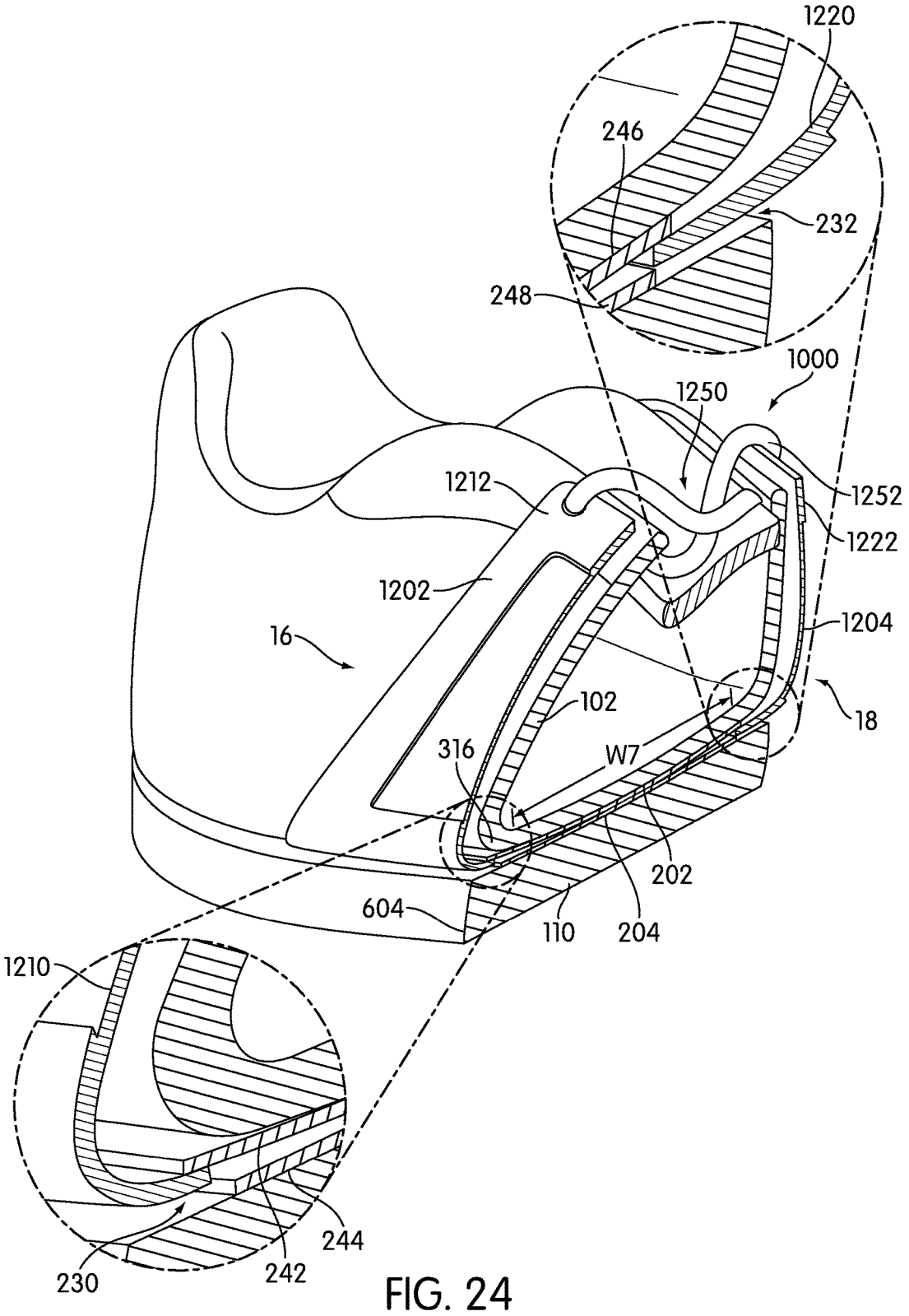
FIG. 24 is an isometric cut-away view of an embodiment of an article of footwear including a strap.
Figure 25:
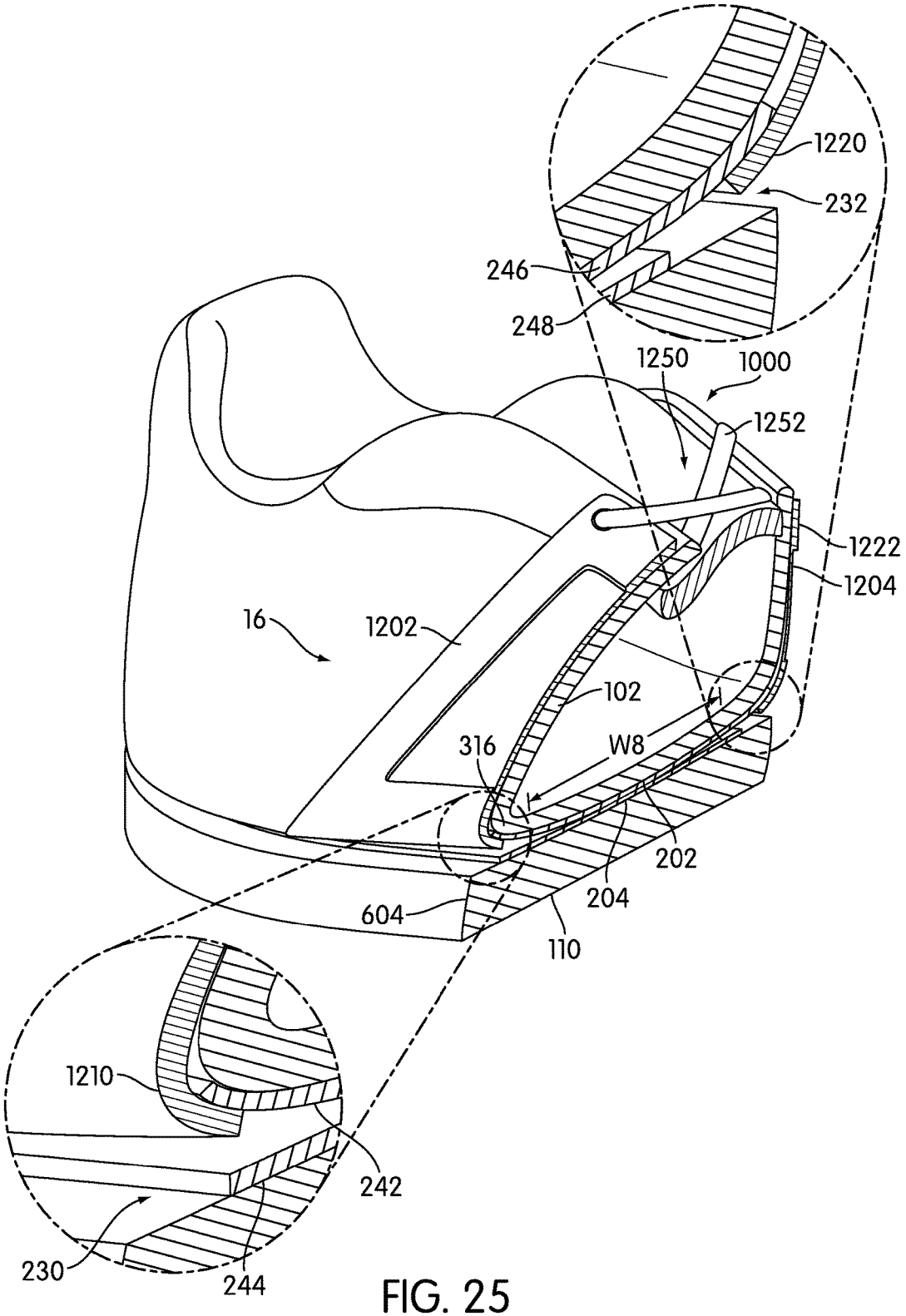
FIG. 25 is an isometric cut-away view of an embodiment of an article of footwear including a strap.

FIGS. 23 through 25 illustrate an embodiment of article of footwear 1000. Article of footwear 1000, hereby referred to simply as article 1000, is substantially similar in many respects to article 100 described earlier, including the placement of forefoot portion 10, midfoot portion 12 and heel portion 14 as well as lateral side 16 and medial side 18. In addition, footwear 1000 includes upper 102, sole structure 110 and connecting member 200 that are substantially similar to that described in the earlier embodiments. Numerals from the first embodiment are used identically in this embodiment to describe the same features.

In some embodiments, article of footwear 1000 may include a fastening system configured to tighten upper 102. Generally, article of footwear 1000 could be associated with any type of fastening system including, but not limited to: laces, straps, zippers, hook and loop fasteners, as well as other types of fastening systems. In an exemplary embodiment, article of footwear 1000 includes a lacing system that comprises lacing region 1250 and lace 1252. Lace 1252 can be used to tighten lacing region 1250 in order to pull lateral side 16 and medial side 18 of upper 102 together.

An article can include provisions for enhancing the ability of an upper to conform to the width of a foot. In embodiments including a connecting member, an article can include a strap for providing tension to a portion of the connecting member. In an exemplary embodiment, an article can include a pair of straps for applying tension to an upper layer of a connecting member.

Referring to FIGS. 23 through 25, article 1000 may include first strap 1202 and second strap 1204. In some cases, first strap 1202 may extend across lateral side 16 of upper 102 at midfoot portion 12. In one embodiment, first strap 1202 may include first end portion 1210 that is attached to first free portion 242 of upper layer 202. Furthermore, first strap 1202 may include second end portion 1212 that is associated with lateral side 16 of lacing region 1250. In some cases, second end portion 1212 may include lacing holes 1214 for receiving lace 1252. Similarly, second strap 1204 may include first end portion 1220 that is attached to second free portion 246 of upper layer 202. Furthermore, second strap 1204 may include second end portion 1222 that is associated with medial side 18 of lacing region 1250. In some cases, second end portion 1222 may include lacing holes (not shown) for receiving lace 1252. With this arrangement, first strap 1202 and second strap 1204 may provide tension to first free portion 242 and second free portion 246 of upper layer 202, respectively, as lace 1252 is adjusted.

As lace 1252 is tightened, first strap 1202 and second strap 1204 may act to pull first free portion 242 and second free portion 246 of upper layer 202 away from first free portion 244 and second free portion 248 of lower layer 204. In other words, first strap 1202 and second strap 1204 may generally open first decoupled portion 230 and second decoupled portion 232 as first strap 1202 and second strap 1204 pull the sidewalls of upper 102 inwardly around a foot. This configuration generally allows for upper 102 to be tightened around a foot to enhance fit and comfort.

As illustrated in FIG. 24, in a loosened position, upper 102 may be associated with width W7. Specifically, this width may generally correspond to a relaxed position for first strap 1202 and second strap 1204. Moreover, in this loosened position, lower periphery 316 of upper 102 is generally disposed over upper periphery 604 of sole structure 110. However, as first strap 1202 and second strap 1204 are tightened, as illustrated in FIG. 25, the width of upper 102 may be substantially reduced to width W8. In this case, first strap 1202 and second strap 1204 apply a tensioning force to upper layer 202 so that first free portion 242 and second free portion 246 are pulled upwards and inwards. This further causes lower periphery 316, which is attached to first free portion 242 and second free portion 244, to contract inwardly. With this arrangement, the width of upper 102 can be adjusted by applying varying amounts of tension to first strap 1202 and second strap 1204 using lace 1252.

Article of footwear 1000 can be made using any known materials. Materials for upper 102, sole structure 110 and connecting member 200 have been discussed above. In addition, straps used with an article of footwear can be made from any suitable material including woven materials, fabrics, leathers, rubbers, elastomers as well as any other materials.

Figure 26:
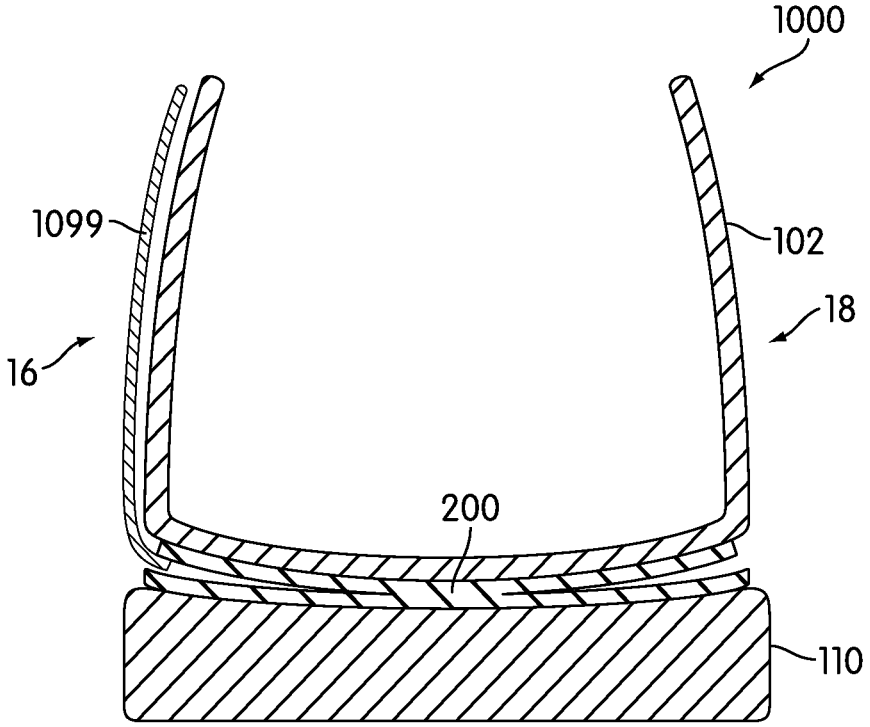
FIG. 26 is a cross sectional view of an embodiment of an article of footwear including a single strap.

In different embodiments, the number of straps could vary. For example, in another embodiment, illustrated in FIG. 26, article of footwear 1000 may include a single strap 1099 that is disposed on lateral side 16. In another embodiment, a single strap could be provided on medial side 18. In still other embodiments, an article could include more than two straps.

An article can include provisions for reducing the number of different materials or components used to manufacture the article. In some embodiments, an article can include one or more straps that are integrally formed with a connecting member. In an exemplary embodiment, the straps for an article can be integrally formed with the upper layer of a connecting member.

Figure 27:
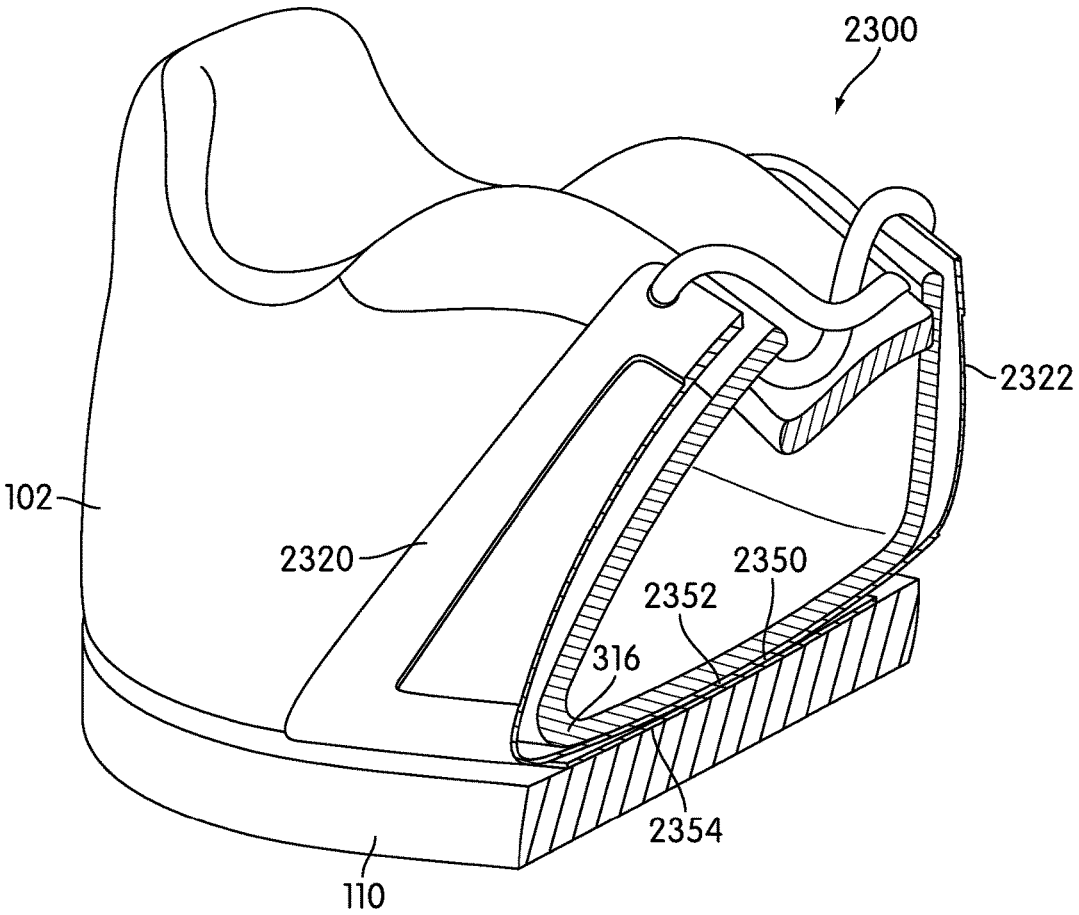
FIG. 27 is an isometric cut-away view of an embodiment of an article of footwear including a strap.
Figure 28:
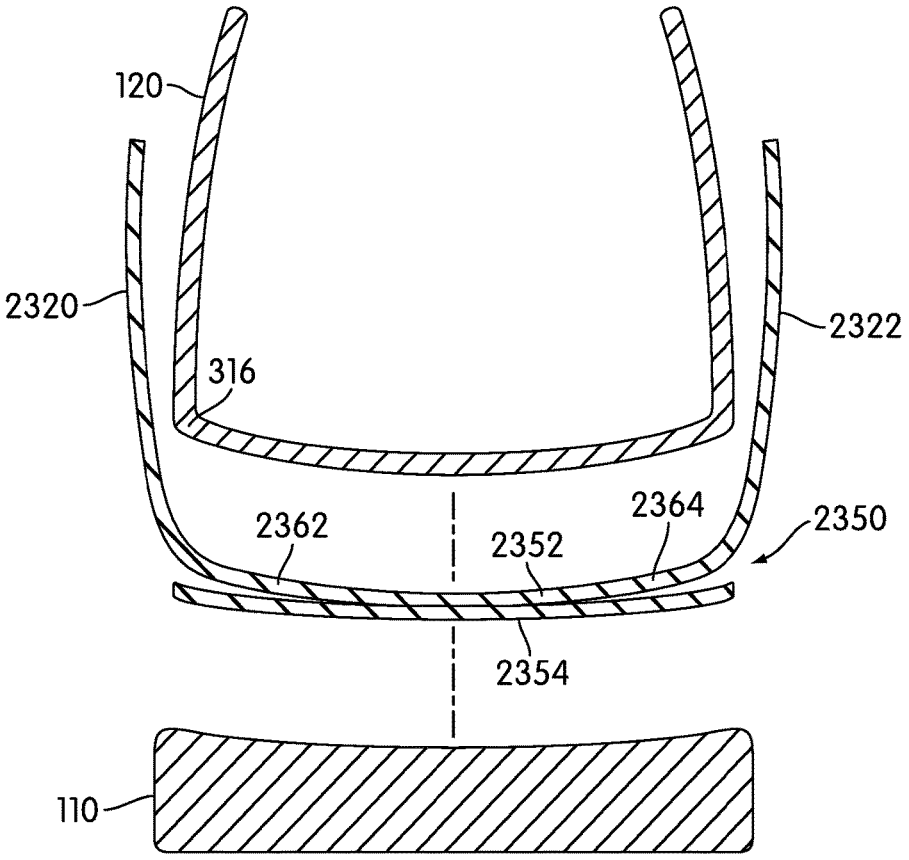
FIG. 28 is an exploded cross sectional view of an embodiment of an article of footwear comprising a strap that extends from a connecting member.

Referring to FIGS. 27 and 28, article of footwear 2300, hereby referred to simply as article 2300, comprises upper 102 and sole structure 110. Article 2300 also includes connecting member 2350 that partially couples upper 102 to sole structure 110. Connecting member 2350 includes upper layer 2352 that attaches to upper 102 and lower layer 2354 that attaches to sole structure 110. Furthermore, article 2300 includes first strap 2320 and second strap 2322 that extend from between upper 102 and sole structure 110.

In the current embodiment, first strap 2320 is integrally formed with first free portion 2362 of upper layer 2352 of connecting member 2350. Likewise, second strap 2322 is integrally formed with second free portion 2364 of upper layer 2352 of connecting member 2350. With this arrangement, as first strap 2320 and second strap 2322 are tightened around a foot, lower periphery 316 of upper 102 may be pulled taut against the bottom of a foot, as first free portion 2362 and second free portion 2364 are pulled upwardly. This arrangement may provide for an enhanced fit for the foot in the region of the foot corresponding to connecting member 2350. Moreover, this configuration reduces the need for separate components to form straps, since the straps are formed continuously from portions of connecting member 2350.

Figure 29:
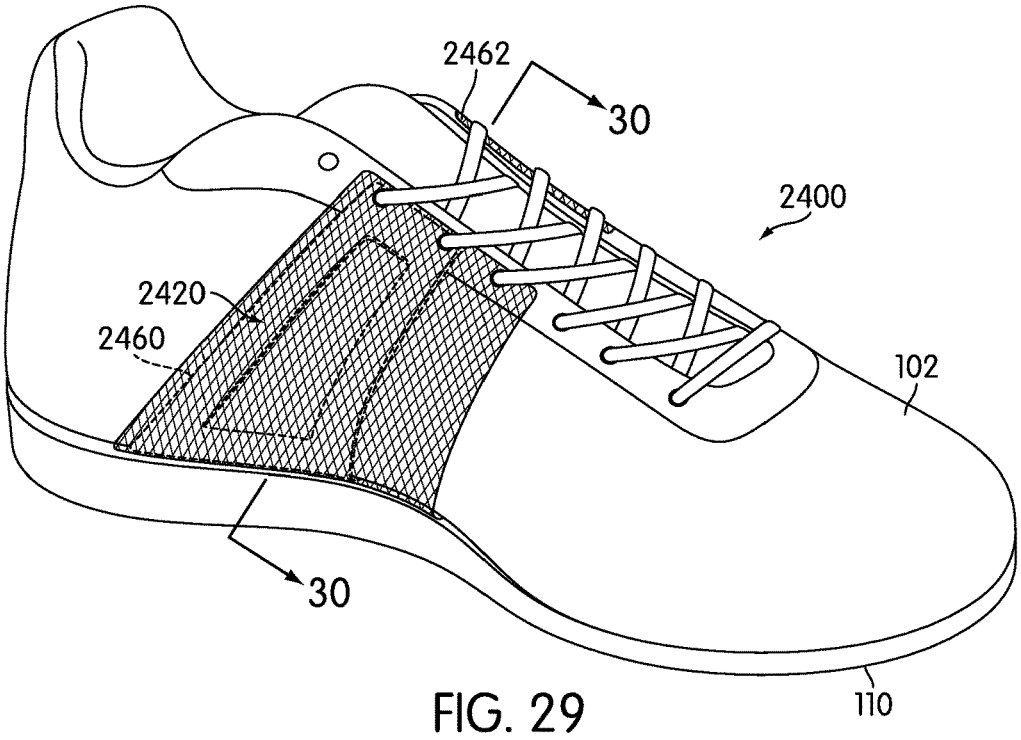
FIG. 29 is an isometric view of an embodiment of an article of footwear comprising a strap and a covering portion.
Figure 30:
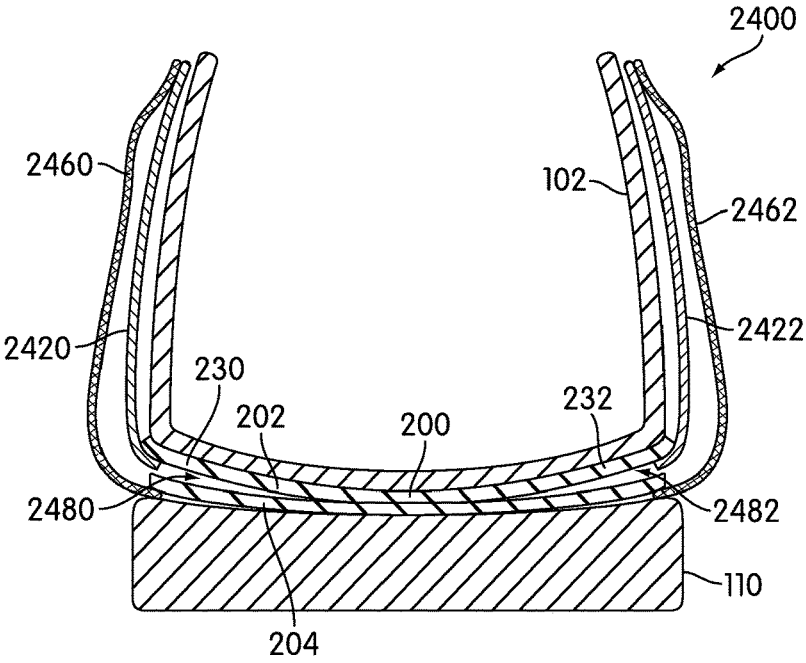
FIG. 30 is a cross sectional view of an embodiment of an article of footwear comprising a strap and a covering portion.

Referring to FIGS. 29 and 30, a strap could be used in combination with a covering portion. In this case, article of footwear 2400 is provided with upper 102 and sole structure 110. Article of footwear 2400, hereby referred to simply as article 2400, is also provided with connecting member 200. Article 2400 also includes first strap 2420 and second strap 2422 that are attached to upper layer 202 of connecting member 200.

In some embodiments, first strap 2420 and second strap 2422 may be covered. In some cases, first strap 2420 and second strap 2422 may be partially covered. In other cases, first strap 2420 and second strap 2422 may be fully covered. In an exemplary embodiment, first strap 2420 and second strap 2422 may be fully covered using first covering portion 2460 and second covering portion 2462. In this case, first covering portion 2460 and second covering portion 2462 may be attached to article 2400 between lower layer 204 of connecting member 200 and sole structure 110, in a similar manner to the arrangement shown previously in FIG. 20. Using this arrangement, first covering portion 2460 may be configured to prevent debris from entering first opening 2480 of first decoupled portion 230. Likewise, second covering portion 2462 may be configured to prevent debris from entering second opening 2482 of second decoupled portion 232.

Although first strap 2420 and second strap 2422 are separate components from connecting member 200 in the current embodiment, in other embodiments, first strap 2420 and second strap 2422 may be integrally formed with connecting member 200. In some cases, first strap 2420 and second strap 2422 could be formed as continuous extensions of upper layer 202 of connecting member 200, as shown in a previous embodiment in FIGS. 27 and 28. Furthermore, while first covering portion 2460 and second covering portion 2462 are separate components from connecting member 200 in the current embodiment, in other embodiments, first covering portion 2460 and second covering portion 2462 may be integrally formed with connecting member 200. In some cases, first covering portion 2460 and second covering portion 2462 may form continuous extensions of lower layer 204 of connecting member 200, as shown in a previous embodiment in FIG. 22.

In some embodiments, one or more straps could be formed continuously with a portion of an upper. In some cases, a strap could be formed as a flap-like portion of an upper. In one embodiment, a strap could be formed by cutting one or more slots into a portion of an upper.

Figure 31:
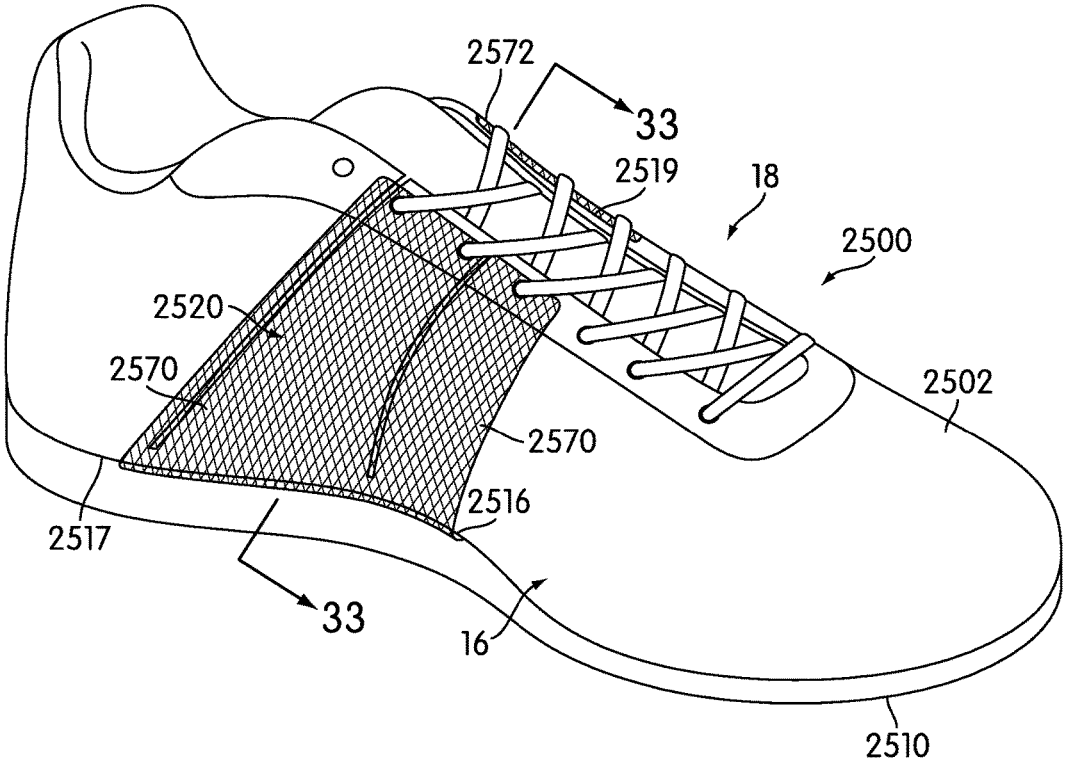
FIG. 31 is an isometric view of an embodiment of an article of footwear comprising an integral strap portion.
Figure 32:
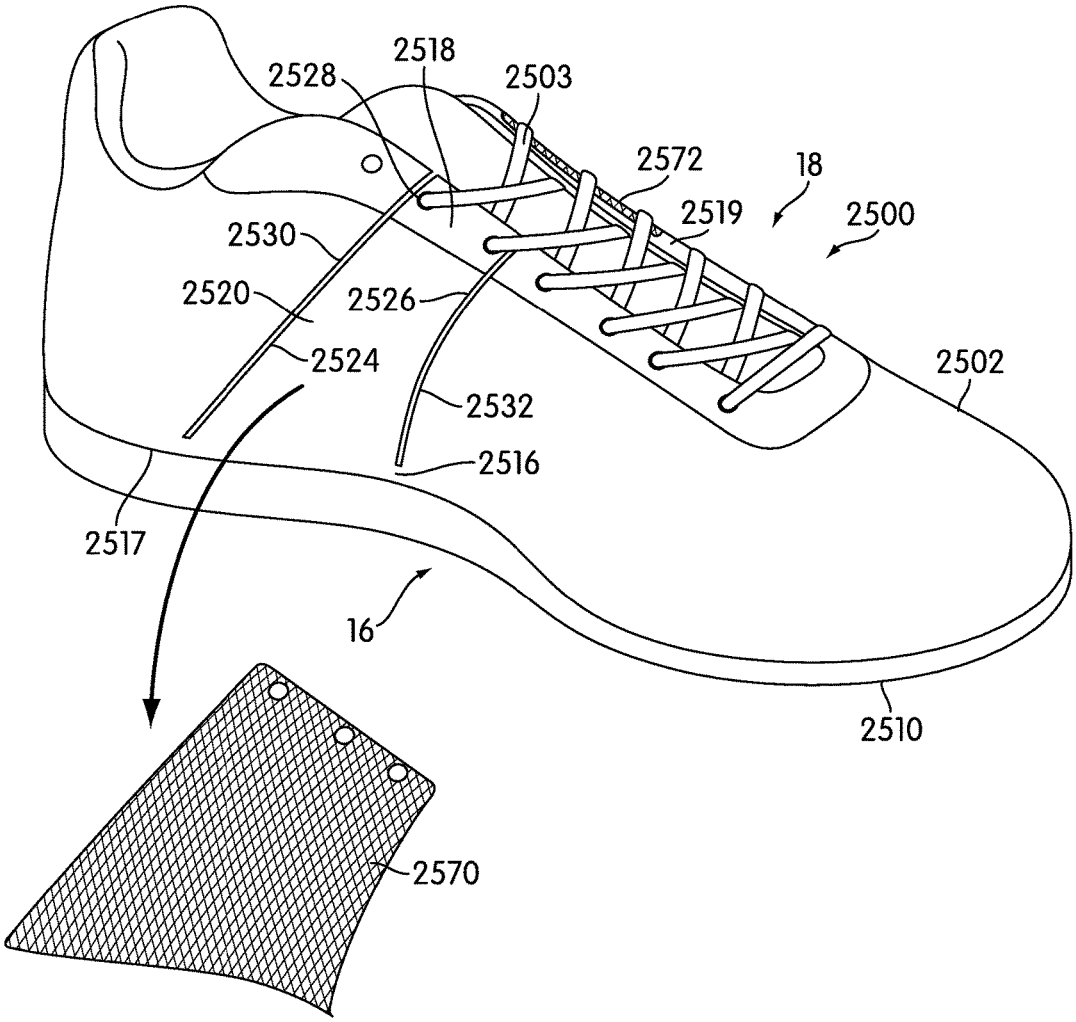
FIG. 32 is an exploded view of an embodiment of an article of footwear comprising an integral strap portion.
Figure 33:
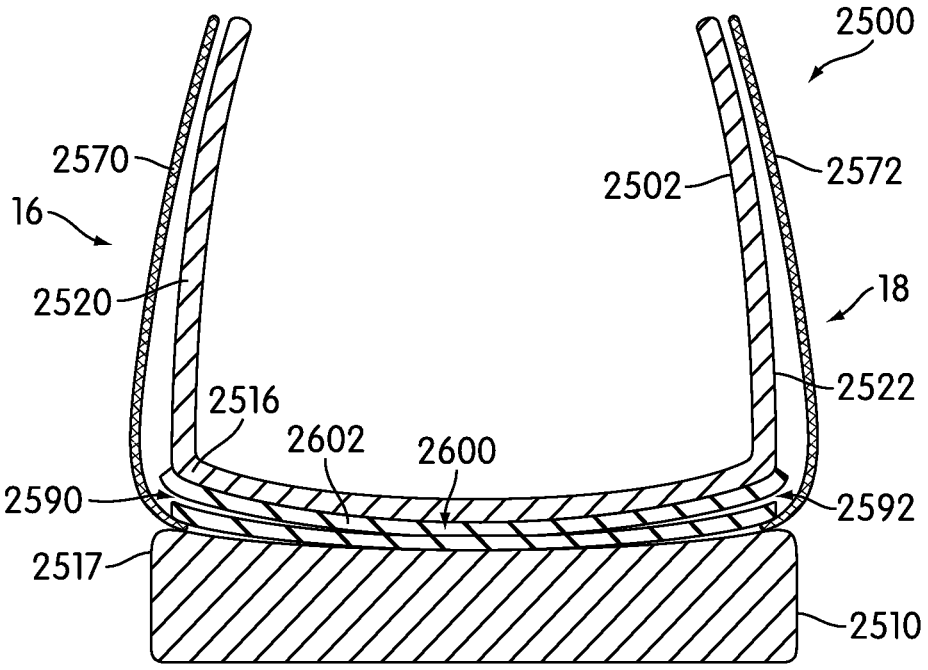
FIG. 33 is a cross sectional view of an embodiment of an article of footwear comprising an integral strap portion.

FIGS. 31 through 33 illustrate an embodiment of article of footwear 2500. Article 2500 may be provided with upper 2502, sole structure 2510, and connecting member 2600 that acts to partially couple upper 2502 with sole structure 2510. In this embodiment, upper 2502 may have substantially similar properties to upper 102 discussed in the previous embodiments. Likewise, sole structure 2510 may have substantially similar properties to sole structure 110 discussed in the previous embodiments. Furthermore, connecting member 2600 may be substantially similar to connecting member 200 of the previous embodiments.

Referring to FIGS. 31 through 33, upper 2502 may include one or more integral straps. In this embodiment, upper 2502 includes first integral strap 2520 that is disposed on lateral side 16 of upper 2502. In addition, upper 2502 may include second integral strap 2522 that is disposed on medial side 18 of upper 2502 and which can be seen in cross section in FIG. 33. For purposes of clarity, the following detailed description discusses first integral strap 2520. However it will be understood that second integral strap 2522 may be substantially similar to first integral strap 2520.

First integral strap 2520 may be a flap-like portion of upper 2502 that extends from lower periphery 2516 of upper 2502. In some cases, first integral strap 2520 may be associated with first slot 2530 and second slot 2532 that separate first edge 2524 and second edge 2526, respectively, of first integral strap 2520 from upper 2502. In other words, this configuration allows first integral strap 2520, which is continuously formed with upper 2502, to move substantially independently from adjacent portions of upper 2502. In particular, with this arrangement, first integral strap 2520 can be tightened around a foot somewhat independently from the remaining portions of upper 2502.

In the current embodiment, first integral strap 2520 extends from lower periphery 2516 of upper 2502 to lateral lacing edge 2518 of upper 2502. Furthermore, first integral strap 2520 includes lacing holes 2528 that are configured to receive lace 2503. As lace 2503 is tightened, first integral strap 2520 is pulled more tightly against the lateral side of a foot. In a similar manner, second integral strap 2522 may also be configured with one or more lacing holes so that second integral strap 2522 may be tightened against a foot when lace 2503 is tightened.

As first integral strap 2520 and second integral strap 2522 are tightened, first integral strap 2520 and second integral strap 2522 may apply tension to upper layer 2602 of connecting member 2600. This allows upper layer 2602 to be tightened around the base of a foot in order to better adjust upper 2502 to the width of a foot. With this arrangement, first integral strap 2520 and second integral strap 2522 may be used to adjust the width of upper 2502 in a similar manner to the embodiment discussed above and shown in FIGS. 24 and 25.

In some embodiments, first covering portion 2570 and second covering portion 2572 may also be used with article 2500. In this case, first covering portion 2570 extends from upper periphery 2517 of sole structure 2510 to lateral lacing edge 2518 of upper 2502. This provides a covering for first opening 2590 associated with connecting member 2600 on lateral side 16. In some cases, first covering portion 2570 can also help prevent debris from entering upper 2502 through first slot 2530 and second slot 2532. Likewise, second covering portion 2572 extends from upper periphery 2517 of sole structure 2510 to medial lacing edge 2519 of upper 2502. This provides a covering for second opening 2592 associated with connecting member 2600 on medial side 18 as well as any associated slots adjacent to second integral strap 2522. It will be understood, however, that in other embodiments, no covering portions may be used.

An article can include provisions for reinforcing an integral strap associated with an upper. In embodiments including a connecting member, portions of the connecting member can be extended to reinforce the integral strap. In one exemplary embodiment, an upper layer of a connecting member can be extended to reinforce an integral strap.

Figure 34:
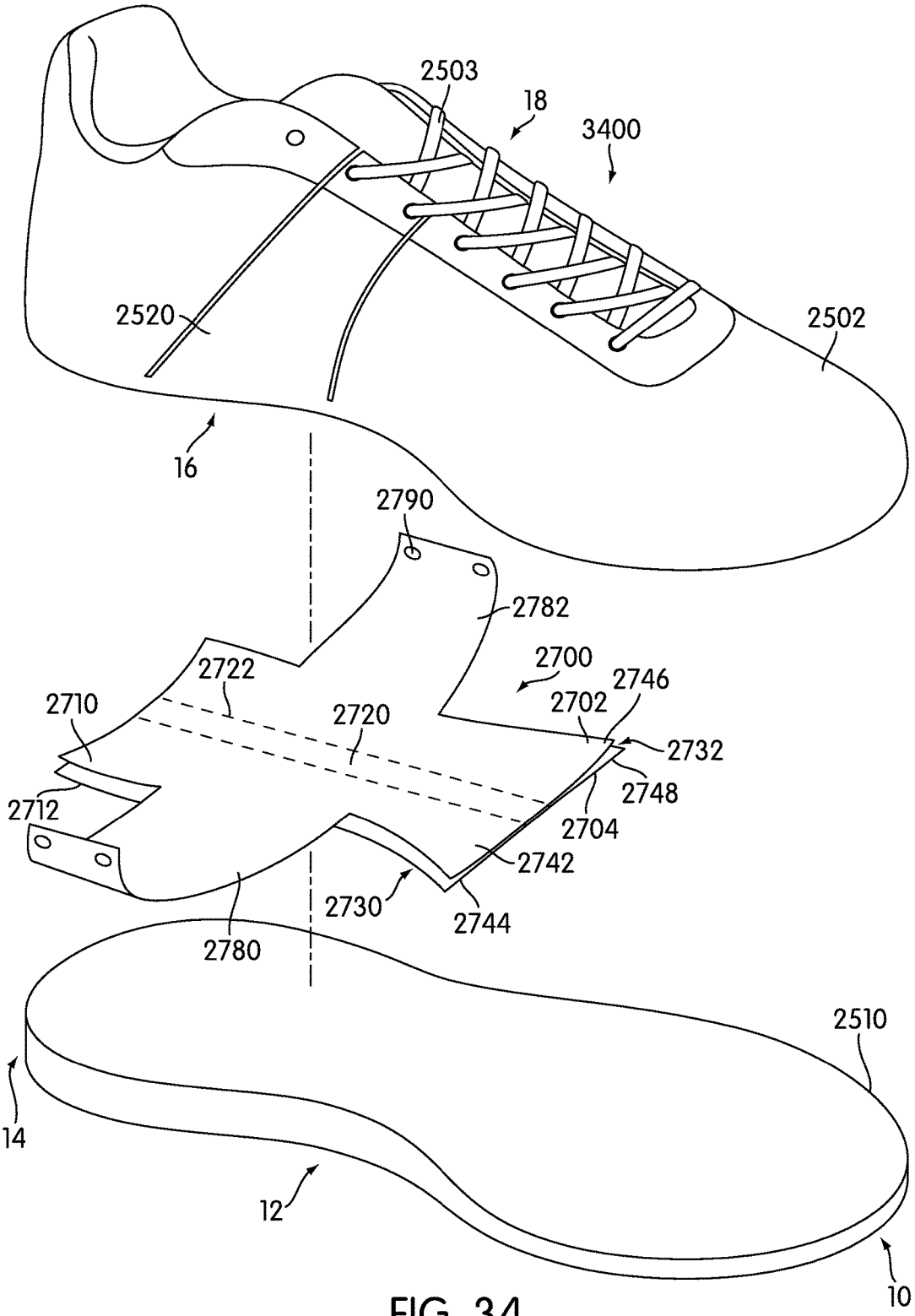
FIG. 34 is an exploded isometric view of an embodiment of an article of footwear comprising a connecting member with extended portions.
Figure 35:
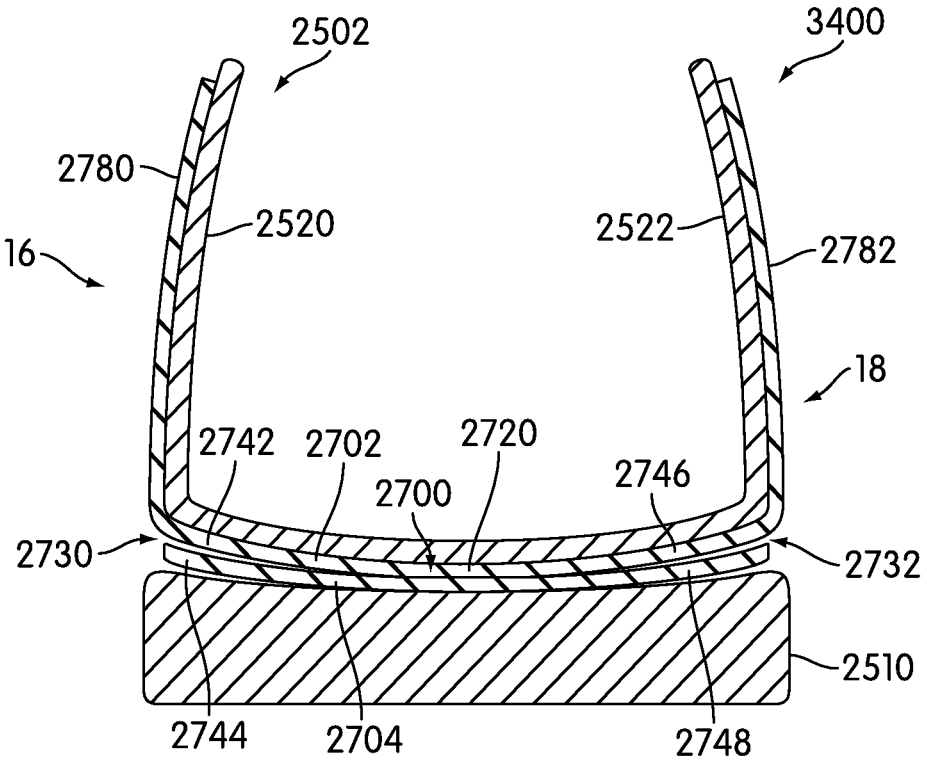
FIG. 35 is a cross sectional view of an embodiment of an article of footwear comprising a connecting member with extended portions.

FIGS. 34 and 35 illustrate another embodiment of an article of footwear that is configured for partial decoupling between an upper and a sole structure. Referring to FIGS. 34 and 35, article of footwear 3400, hereby referred to simply as article 3400, includes upper 2502 and sole structure 2510. Upper 2502 includes first integral strap 2520 and second integral strap 2522, which have been previously discussed in an earlier embodiment. In particular, first integral strap 2520 and second integral strap 2522 form flap-like portions of upper 2502 that can move substantially independently from adjacent portions of upper 2502. With this arrangement, first integral strap 2520 and second integral strap 2522 may be tightened around a foot during use.

Article 3400 includes connecting member 2700 that is used to partially decouple upper 2502 and sole structure 2510. Connecting member 2700 may generally be disposed between upper 2502 and sole structure 2510 and may be used for connecting portions of upper 2502 to portions of sole structure 2510. In particular, the current embodiment illustrates connecting member 2700 being generally disposed between upper 2502 and sole structure 2510 at midfoot portion 12 of article 3400, as well as some portions of forefoot portion 10 and heel portion 14.

In some embodiments, connecting member 2700 may further comprise a layered structure. In some cases, connecting member 2700 may comprise two layers. In other cases, connecting member 2700 may comprise more than two layers. In one embodiment, connecting member 2700 may comprise upper layer 2702 and lower layer 2704.

Upper layer 2702 and lower layer 2704 may be joined at central attachment portion 2720. In particular, central attachment portion 2720 is a substantially narrow portion that extends longitudinally through connecting member 2700. Upper layer 2702 and lower layer 2704 can be attached using any means known in the art. In some cases, upper layer 2702 could be attached to lower layer 2704 by stitching. In other cases, upper layer 2702 could be attached to lower layer 2704 using an adhesive of some kind. It will be understood that the method of attaching upper layer 2702 to lower layer 2704 can be selected according to the material properties of upper layer 2702 and lower layer 2704, as well as desired structural properties for connecting member 2700. In an exemplary embodiment, upper layer 2702 may be attached to lower layer 2704 using stitching 2722.

Connecting member 2700 may comprise one or more decoupled portions. In the current embodiment, connecting member 2700 includes first decoupled portion 2730 and second decoupled portion 2732. First decoupled portion 2730 extends generally laterally from central attachment portion 2720 to lateral side 16 of connecting member 2700. Moreover, first decoupled portion 2730 includes first free portion 2742 of upper layer 2702 and first free portion 2744 of lower layer 2704. Second decoupled portion 2732 extends generally laterally from central attachment portion 2720 to medial side 18 of connecting member 2700. Moreover, second decouple portion 2732 includes second free portion 2746 of upper layer 2702 and second free portion 2748 of lower layer 2704. With this arrangement, first free portion 2742 of upper layer 2702 may be configured to move substantially independently of first free portion 2744 of lower layer 2704. Likewise, second free portion 2746 of upper layer 2702 may be configured to move substantially independently of second free portion 2748 of lower layer 2704.

Generally, the geometries of upper layer 2702 and lower layer 2704 can vary. In some cases, upper layer 2702 and lower layer 2704 may have substantially planar geometries such that the thickness of each layer is substantially less than the associated lengths and widths of each layer. In addition, in some cases, upper periphery 2710 of upper layer 2702 and lower periphery 2712 of lower layer 2704 may be contoured in a manner to correspond to the contouring of upper 2502 and sole structure 2510.

In some embodiments, the geometry of upper layer 2702 may vary from the geometry of lower layer 2704. In some cases, upper layer 2702 may comprise one or more extended portions. In the current embodiment, upper layer 2702 includes first extended portion 2780 that extends continuously from first free portion 2742. First extended portion 2780 may be generally shaped like first integral strap 2520 and may be configured to wrap around and reinforce first integral strap 2520. Upper layer 2702 may also include second extended portion 2782 that extends continuously from second free portion 2746. Second extended portion 2782 may be generally shaped like second integral strap 2522 and may be configured to wrap around and reinforce second integral strap 2522.

In some embodiments, first extended portion 2780 and second extended portion 2782 may be provided with lacing holes 2790 that are configured to engage lace 2503. With this arrangement, as lace 2503 is tightened, first extended portion 2780 and first integral strap 2520 may be tightened against a foot. Likewise, as lace 2503 is tightened, both second extended portion 2782 and second integral strap 2522 may be tightened against a foot. This arrangement helps provide increased support to first integral strap 2520 and second integral strap 2522. Moreover, using this configuration, the width of upper 2502 at midfoot portion 12 can be adjusted by controlling the amount of tension in upper layer 2702 of connecting member 2700 via lace 2503.

An article can include provisions for reinforcing one or more portions of a connecting member. In some cases, a connecting member can include threads that provide structural support. Articles with threads configured to provide structural support have been previously disclosed in U.S. Patent Application Publication No. 2007/0271822, to Meschter, the entirety of which is hereby incorporated by reference. In addition, U.S. Patent Application Publication No. 2007/0271823, also to Meschter, is hereby incorporated by reference. These two references will be referred to as the thread structural elements cases throughout the remainder of this detailed description.

Figure 36:
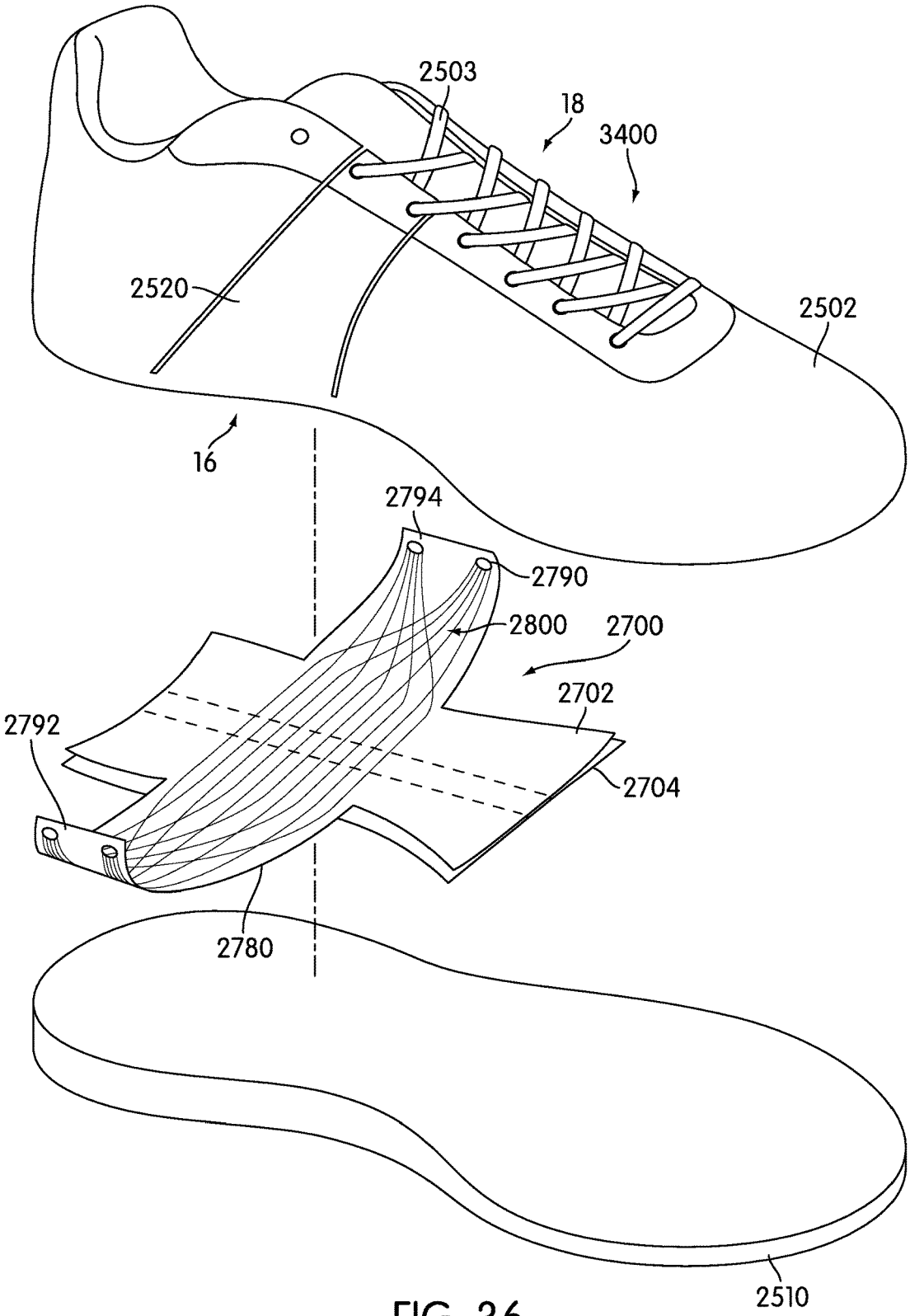
FIG. 36 is an exploded isometric view of an embodiment of an article of footwear comprising a connecting member including a plurality of threads.
Figure 37:
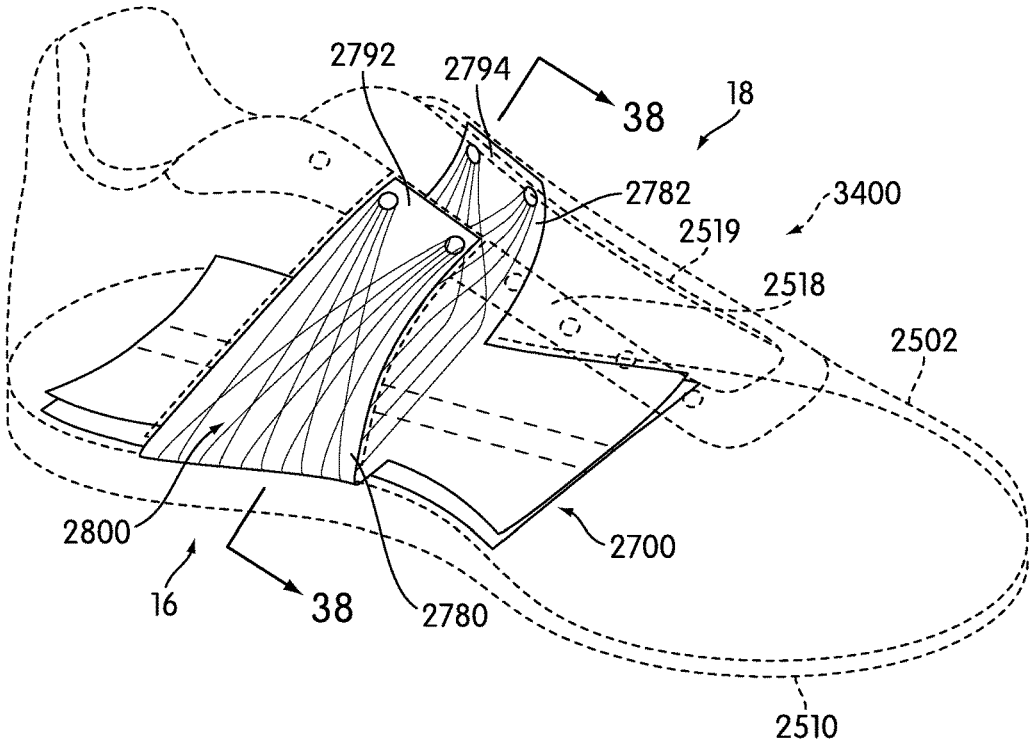
FIG. 37 is an isometric view of an embodiment of an article of footwear comprising a connecting member including a plurality of threads.
Figure 38:
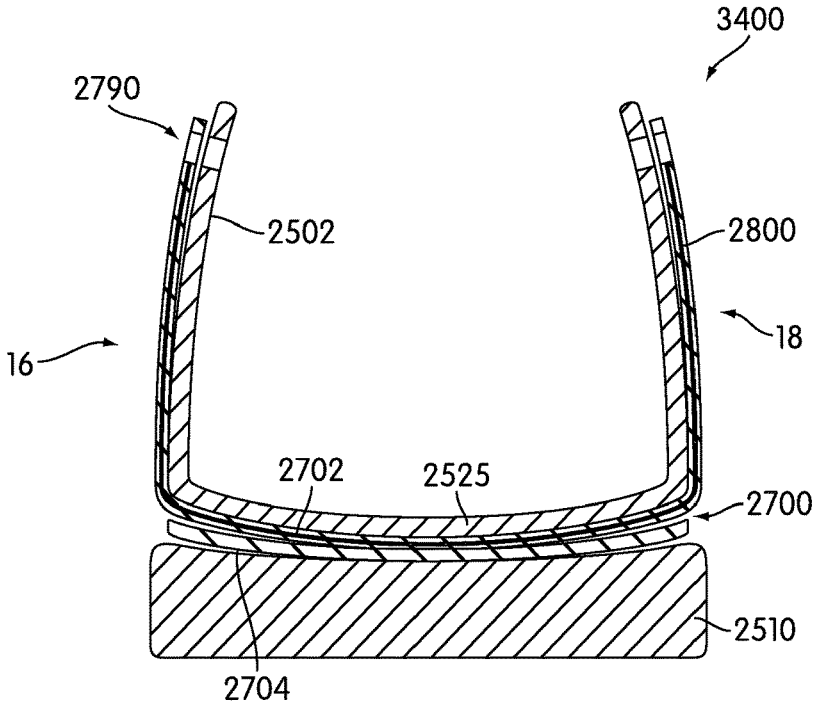
FIG. 38 is a cross sectional view of an embodiment of an article of footwear comprising a connecting member including a plurality of threads.

Referring now to FIGS. 36 through 38, in another embodiment, connecting member 2700 may be associated with plurality of threads 2800, hereby referred to simply as threads 2800. In some embodiments, threads 2800 may be disposed on a base layer of some kind. In some cases, threads 2800 may be disposed on a surface of upper layer 2702 of connecting member 2700. In other cases, threads 2800 may be disposed on a surface of lower layer 2704. In still other cases, threads 2800 may be disposed on both upper layer 2702 and lower layer 2704. In an exemplary embodiment, threads 2800 may generally be disposed on a surface of upper layer 2702. Furthermore, plurality of threads 2800 may extend from end portion 2792 of first extended portion 2780 to end portion 2794 of second extended portion 2782.

In some cases, some portions of threads 2800 may be parallel to the surface of upper layer 2702. In other words, portions of threads 2800 may be exposed on the surface of upper layer 2702, rather than embedded within upper layer 2702. In other cases, portions of threads 2800 may extend through upper layer 2702. In areas where threads 2800 extend through upper layer 2702, threads 2800 may be directly joined or otherwise secured to upper layer 2702. In other cases, portions of threads 2800 can lie adjacent to upper layer 2702. In areas where threads 2800 lie adjacent to upper layer 2702, threads 2800 may be unsecured to upper layer 2702 or may be joined using a connecting layer or other securing element that bonds, secures, or otherwise joins portions of threads 2800 to upper layer 2702.

In some embodiments, in order to form structural elements in upper layer 2702, multiple threads 2800 or sections of an individual thread of threads 2800 may be collected into one of various thread groups. In other embodiments, however, threads 2800 may not be organized into different thread groups.

In some embodiments, threads 2800 may begin and end at one or more lacing holes. For example, in the current embodiment, threads 2800 are connected to lacing holes 2790. In some cases, threads 2800 may be packed closer together in the regions adjacent to lacing holes 2790.

In different embodiments, threads of a thread group can be arranged in various ways. For example, in some cases, each thread of a thread group can be extended in a substantially straight manner from a first end portion to a second end portion of the thread group. In other cases, however, a thread may have various portions that are angled with respect to one another. In still other cases, a thread may be arranged in a curved shape.

The process of applying threads 2800 to upper layer 2702 can be achieved using any method known in the art. In particular, the order of application of different threads from various thread groups can vary from one embodiment to another. Examples of a process for applying threads to an upper for an article of footwear are discussed in the thread structural elements cases. It will be understood that similar methods could be used for applying threads to a base layer for a harness.

In different embodiments, each thread of threads 2800 may be secured to upper layer 2702 in various ways. In one embodiment, end portions of threads 2800 can be secured to upper layer 2702 using a lock stitch. In addition, intermediate portions of threads 2800 may be attached to upper layer 2702 using a connecting layer that bonds, secures, or otherwise joins portions of threads 2800 to upper layer 2702. In other embodiments, however, threads 2800 could be embedded in upper layer 2702, especially in embodiments where upper layer 2702 comprises a polymer layer.

During use of article 2500, forces induced in article 3400 may tend to stretch portions of upper 2502 and upper layer 2702, which is partially wrapped around upper 2502. Each of threads 2800 are located to form structural elements in connecting member 2700. These structural elements may help resist stretching in various directions and reinforce locations where forces are concentrated. In particular, in some embodiments, threads 2800 substantially restrain stretch of upper layer 2702 in a direction corresponding to a longitudinal axis of the threads. In the current embodiment, this direction corresponds generally to a lateral direction across connecting member 2700, which helps first extended portion 2780 and second extended portion 2782 maintain tension around portions of upper 2502.

FIGS. 37 and 38 illustrate an isometric view of an embodiment of article of footwear 3400 and a cross sectional view of an embodiment of article 3400. For purposes of clarity, upper 2502 and sole structure 2510 are shown in phantom in FIG. 37. As seen in FIGS. 37 and 38, the current design provides threading that substantially surrounds upper 2502. In particular, threads 2800 are provided on lateral side 16 and medial side 18 of upper 2502. In addition, threads 2800 are provided beneath lower portion 2525 of upper 2502. Moreover threads 2800 extend substantially continuously from lateral lacing edge 2518 to medial lacing edge 2519 by extending around lateral side 16, beneath lower portion 2525 and around medial side 18. With this arrangement, a foot inserted into upper is supported by threads 2800 on almost all sides, with the exception of the very top of the foot which corresponds to the opening of the lacing region. In particular, the bottom portion of a foot may be supported below by portions of threads 2800 that extend across lower layer 2704 and beneath lower portion 2525.

In some embodiments, threads 2800 may provide different amounts of coverage in a direction circumscribing upper 2502. In some cases, threads 2800 may provide approximately 180 degrees or more of substantially continuous coverage around upper 2502. In other cases, threads 2800 may provide approximately 270 degrees or more of substantially continuous coverage around upper 2502. In still other cases threads 2800 may provide approximately 330 degrees or more of substantially continuous coverage around upper 2502. In still other cases, threads 2800 may provide approximately 350 degrees or more of substantially continuous coverage around upper 2502. In embodiments without a lacing region, or in embodiments where threads 2800 extend over the lacing region, threads 2800 could provide approximately 360 degrees of substantially continuous coverage. By circumscribing a greater amount of upper 2502, threads 2800 may provide a greater amount of support for a foot.

Although the current embodiment includes threads that are applied to an upper layer in a connecting member, in other embodiments, threads could be applied to any other base layer in an article. In some cases, threads could be applied to a lower layer of a connecting member. In still other cases, threads could be applied to both an upper layer and a lower layer of a connecting member. In still other cases, threads could be applied directly to portions of an upper.

A connecting member could be provided with multiple extended portions on each side. In some cases, a connecting member could include two or more extended portions on each side. In an exemplary embodiment, a connecting member could include three extended portions on each side.

Figure 39:
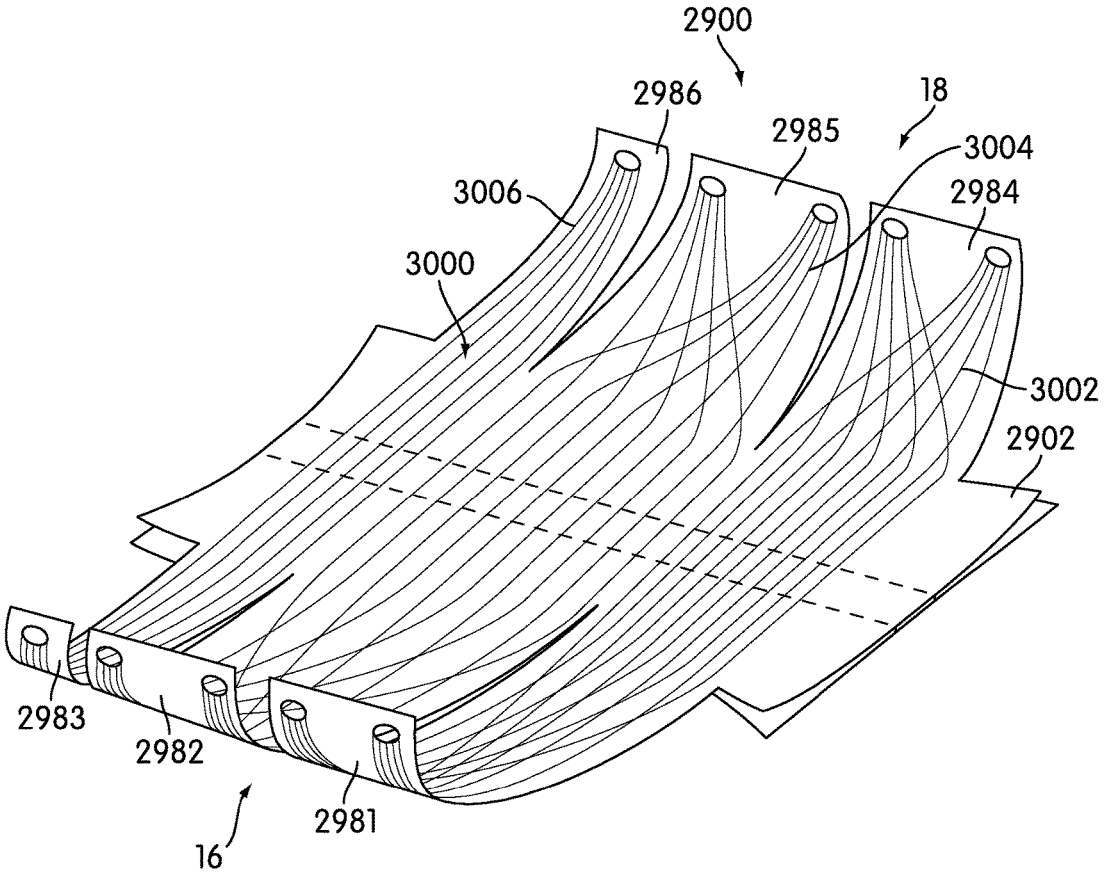
FIG. 39 is an isometric view of an embodiment of a connecting member comprising threads.

Referring to FIG. 39, connecting member 2900 includes first extended portion 2981, second extended portion 2982 and third extended portion 2983 disposed on lateral side 16. In addition, connecting member 2900 includes fourth extended portion 2984, fifth extended portion 2985 and sixth extended portion 2986 on medial side 18. Moreover, each extended portion is continuously formed with upper layer 2902 of connecting member 2900.

In some cases, connecting member 2900 can include plurality of threads 3000 that extend through a majority of upper layer 2902. In this case, threads 3000 includes first thread set 3002, second thread set 3004 and third thread set 3006. First thread set 3002 includes threads that extend from first extended portion 2981 to fourth extended portion 2984. Second thread set 3004 includes threads that extend from second extended portion 2982 to fifth extended portion 2985. Additionally, third thread set 3006 includes threads that extend from third extended portion 2983 to sixth extended portion 2986. This arrangement may provide increased structural support to the extended portions of connecting member 2900, as well as a majority of upper layer 2902.

Figure 40:
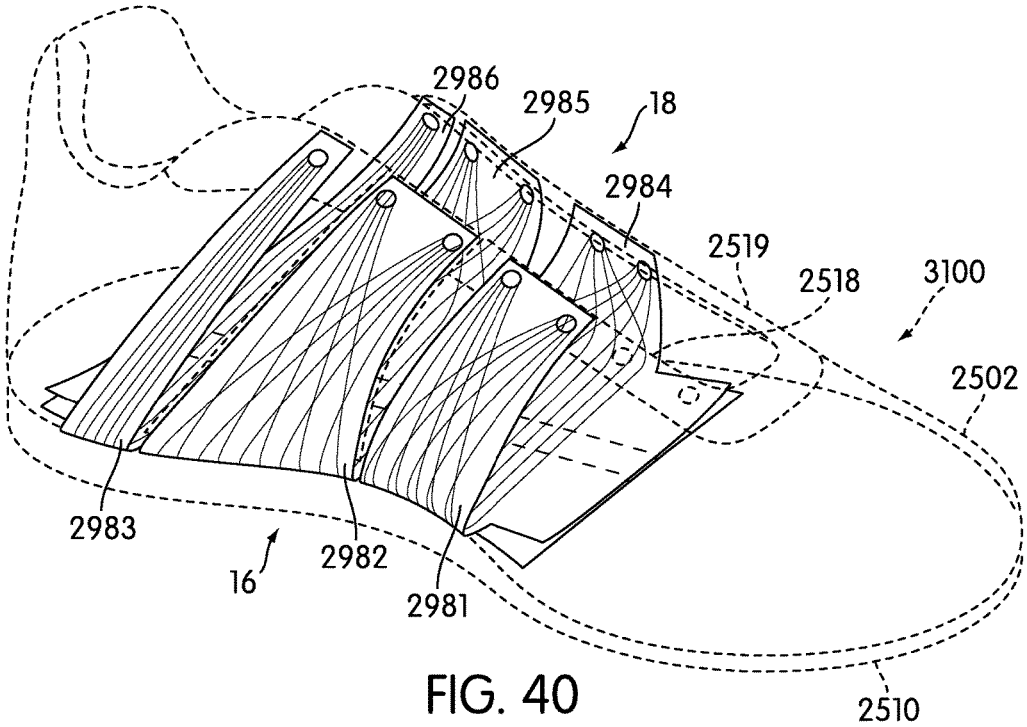
FIG. 40 is an isometric view of an embodiment of an article of footwear including a connecting member with threads.
Figure 41:
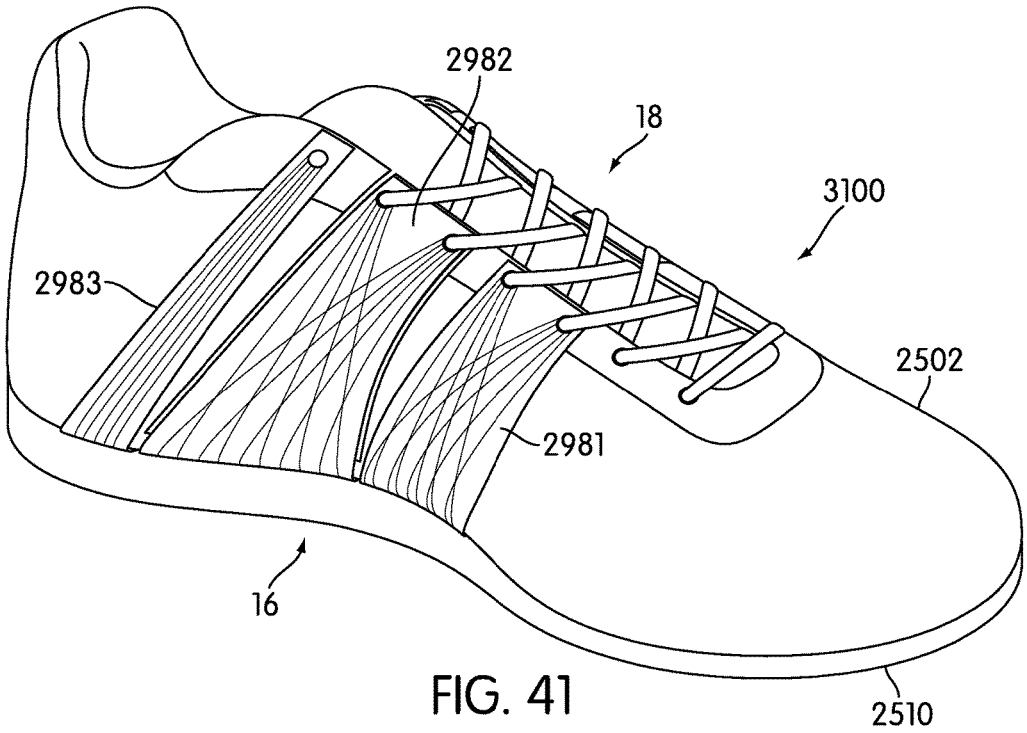
FIG. 41 is an isometric view of an embodiment of an article of footwear including a connecting member with threads.

FIG. 40 illustrates an isometric view of an embodiment of article of footwear 3100 that includes connecting member 2900. For purposes of clarity, upper 2502 and sole structure 2510 are shown in phantom in the current embodiment. FIG. 41 illustrates an isometric view of an embodiment of article of footwear 3100.

Referring to FIGS. 40 and 41, each extended portion may wrap around either lateral side 16 or medial side 18 of upper 2502. In this case, first extended portion 2981, second extended portion 2982 and third extended portion 2983 may wrap onto lateral side 16 of upper 2502. In some cases, second extended portion 2982 may overlap with first integral strap 2520. Moreover, each of first extended portion 2981, second extended portion 2982 and third extended portion 2983 may be attached to lateral lacing edge 2518. In addition, fourth extended portion 2984, fifth extended portion 2985 and sixth extended portion 2986 may wrap onto medial side 18 of upper 2502. In some cases, fifth extended portion 2985 may overlap with second integral strap 2522. Each of fourth extended portion 2984, fifth extended portion 2985 and sixth extended portion 2986 may be attached to medial lacing edge 2519. With this arrangement, connecting member 2900 may provide enhanced support for upper 2502 as well as allowing upper 2502 to partially decouple from sole structure 2510.

Figure 42:
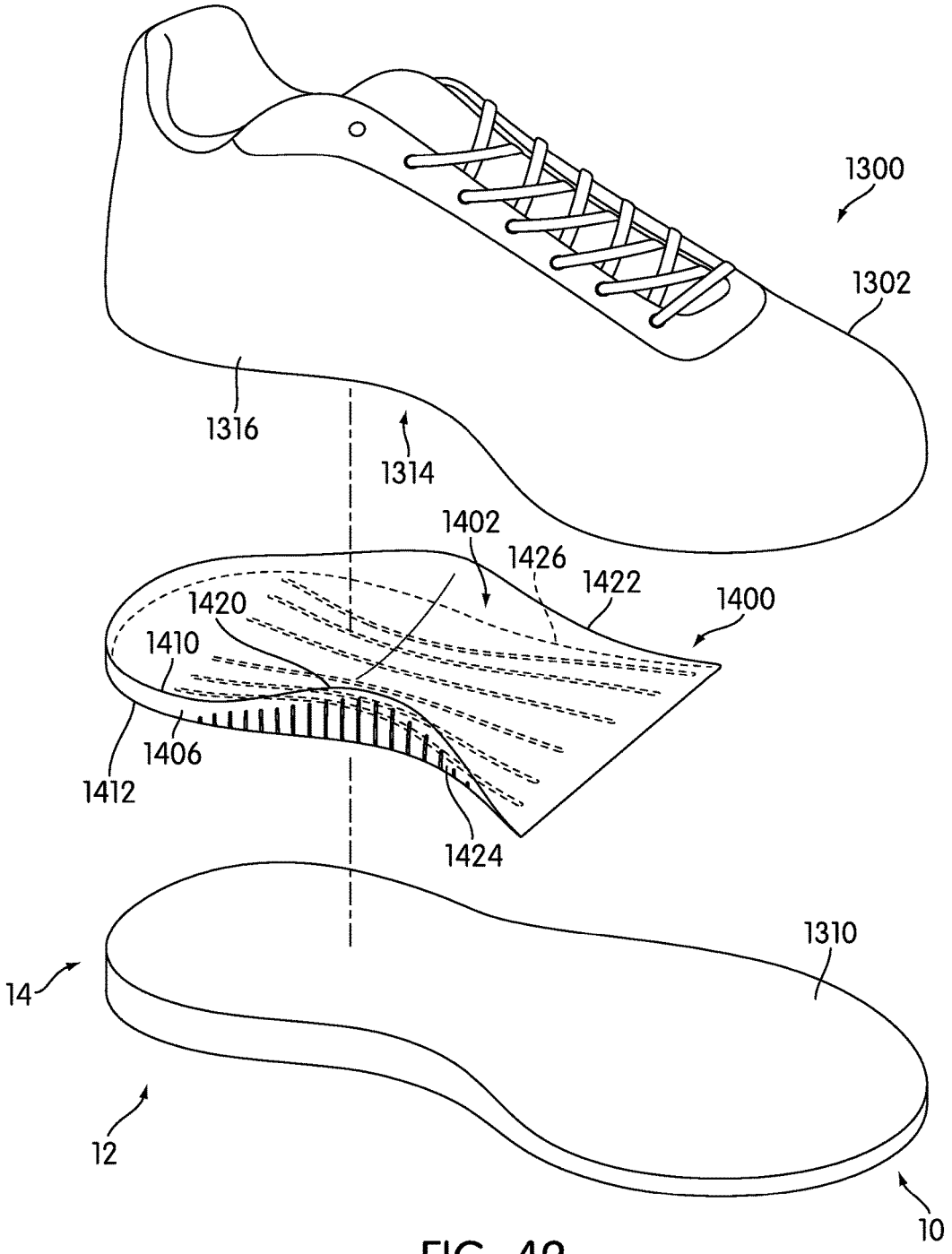
FIG. 42 is an exploded isometric view of an embodiment of an article of footwear.

FIGS. 42 through 46 illustrate another embodiment of a connecting member for article 1300, hereby referred to simply as article 1300. Referring to FIG. 42, article 1300 is substantially similar in many respects to article 100 described earlier, including the placement of forefoot portion 10, midfoot portion 12 and heel portion 14 as well as lateral side 16 and medial side 18. In addition, article of footwear 1300 includes upper 1302 and sole structure 1310 that are substantially similar that described in the earlier embodiments. Numerals from the first embodiment are used identically in this embodiment to describe the same features.

In some embodiments, article 1300 may include a fastening system configured to tighten upper 1302. Generally, article of footwear 1300 could be associated with any type of fastening system including, but not limited to: laces, straps, zippers, hook and loop fasteners, as well as other types of fastening systems. In an exemplary embodiment, article 1300 includes a lacing system that comprises lacing region 1350 and lace 1352. Lace 1352 can be used to tighten lacing region 1350 in order to pull lateral and medial sides of upper 1302 together.

Figure 43:
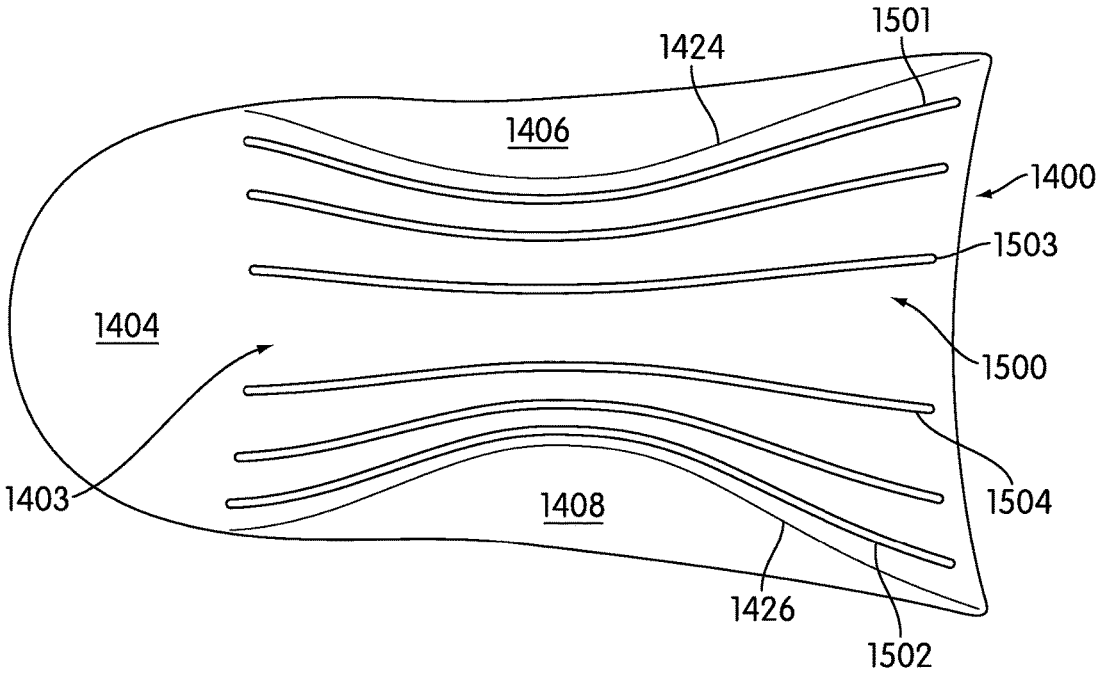
FIG. 43 is a bottom view of an embodiment of a connecting member.

Referring to FIGS. 42 and 43, article of footwear 1300 can include connecting member 1400. Connecting member 1400 may generally be disposed between upper 1302 and sole structure 1310 and may be used for connecting portions of upper 1302 to portions of sole structure 1310. In particular, the current embodiment illustrates connecting member 1400 being generally disposed between upper 1302 and sole structure 1310 at midfoot portion 12 of article 1300, as well as some portions of forefoot portion 10 and heel portion 14.

Connecting member 1400 can include upper portion 1402 and lower portion 1404. Upper portion 1402 may be associated with upper 1302. Lower portion 1404 may be associated with sole structure 1310. Connecting member 1400 may also include first sidewall 1406 and second side wall 1408 that extend between upper portion 1402 and lower portion 1404. Also, connecting member 1400 can include first upper peripheral edge 1420 that is disposed between upper portion 1402 and first sidewall 1406 and second upper peripheral edge 1422 that is disposed between upper portion 1402 and second sidewall 1408. Connecting member 1400 may also include first lower peripheral edge 1424 that is disposed between lower portion 1404 and first sidewall 1406 and second lower peripheral edge 1426 that is disposed between lower portion 1404 and second sidewall 1408.

In different embodiments, the geometry of connecting member 1400 can vary. In some embodiments, connecting member 1400 may be a substantially monolithic portion. In addition, in some embodiments, connecting member 1400 may have an approximately tapered geometry. In some cases, first sidewall 1406 and second sidewall 1408 may be tapered from midfoot portion 12 towards forefoot portion 10 and heel portion 14. In other words, the height of first sidewall 1406 and second sidewall 1408 may be greatest at midfoot portion 12. Furthermore, upper periphery 1410 and lower periphery 1412 of connecting member 1400 may be contoured in a similar manner to upper 1302 and sole structure 1310. In other embodiments, however, connecting member 1400 could have any kind of geometry.

In different embodiments, the rigidity of connecting member 1400 may vary. In some cases, connecting member 1400 may be substantially rigid. In other cases, connecting member 1400 may be substantially flexible. In other cases, connecting member 1400 could include substantially rigid portions and substantially flexible portions. In an exemplary embodiment, connecting member 1400 may be partially compressible to provide impact absorption for article 1300.

Connecting member 1400 may be attached to upper 1302. In some cases, upper portion 1402 may be attached to upper 1302. In some embodiments, a substantial entirety of upper portion 1402 may be attached to lower portion 1314 of upper 1302. Furthermore, in some cases, first upper peripheral edge 1420 and second upper peripheral edge 1422 may be attached to lower periphery 1316 of upper 1302.

A connecting member can include provisions for providing partial decoupling between an upper and a sole structure.

In some cases, a connecting member can include provisions for selectively determining the attachment regions between a connecting member and a sole structure. In an exemplary embodiment, a connecting member can include markings for indicating various possible attachment regions between a connecting member and a sole structure.

In the current embodiment, lower portion 1404 of connecting member 1400 can include markings 1500. In some cases, markings 1500 may comprise lines that may be used to select a predetermined attachment region between connecting member 1400 and markings 1500. In some cases, markings 1500 could be linear lines. In other cases, markings 1500 could be curved and/or nonlinear lines.

Generally, markings 1500 could be created using methods. In some cases, markings 1500 could be formed using pigments of some kind. In other cases, markings 1500 could be formed as grooves or etched into lower portion 1404. In still other cases, markings 1500 could be associated with lower portion 1404 in any other manner.

Markings 1500 generally comprise corresponding pairs of lines that define an intermediate attachment region for attaching connecting member 1400 to sole structure 1310. For example, markings 1500 may include first line 1501 and second line 1502, which are disposed nearest to first lower peripheral edge 1424 and second lower peripheral edge 1426, respectively. In addition, markings 1500 may include third line 1503 and fourth line 1504 that are disposed closest to central portion 1403 of connecting member 1400. Each pair of opposing lines defines an intermediate attachment region. This is best illustrated with reference to FIGS. 44 and 45.

Figure 44:
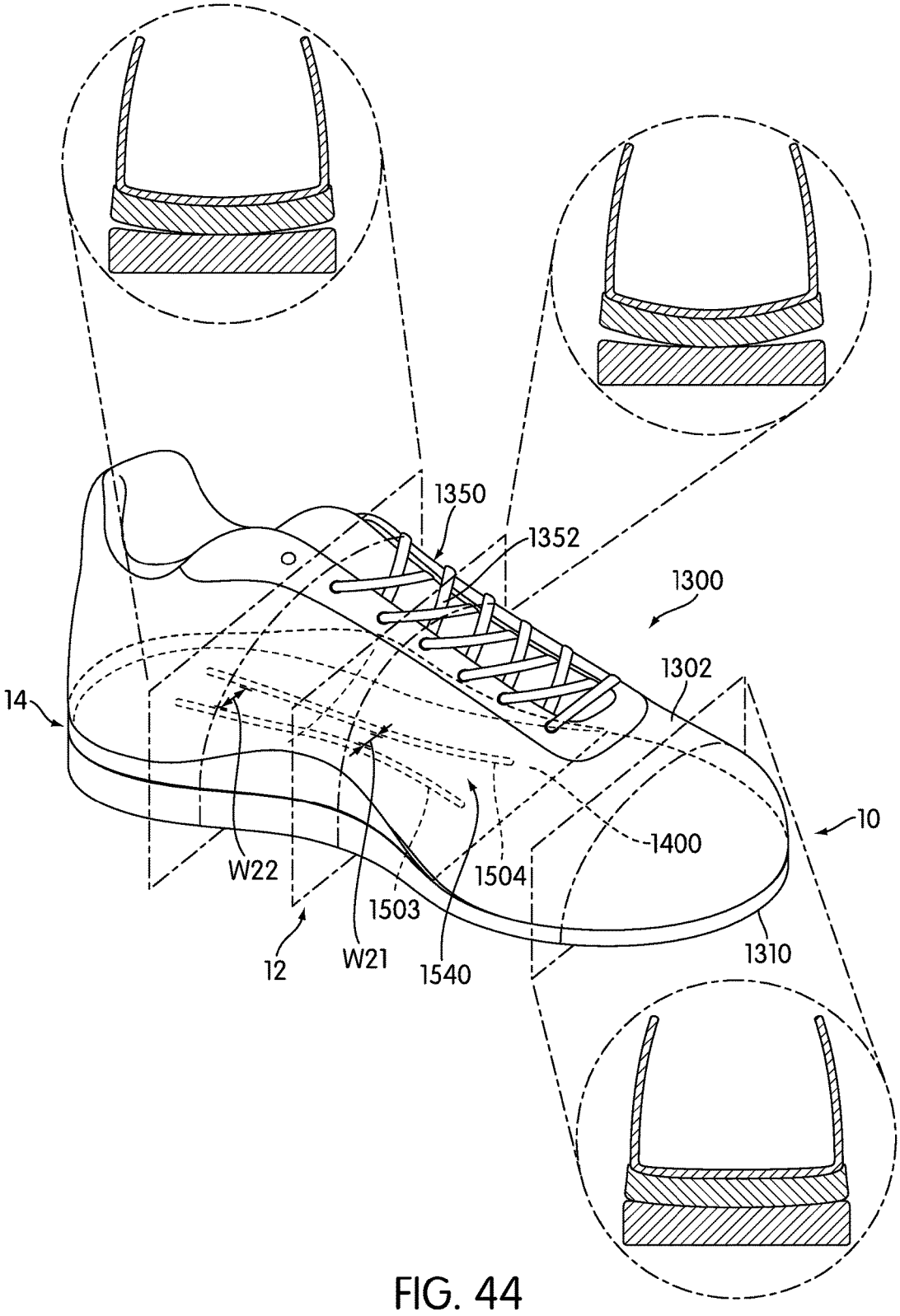
FIG. 44 is an isometric view of an embodiment of a connecting member attached to a sole structure using a first attachment region.

Referring to FIG. 44, lower portion 1404 of connecting member 1400 has been attached to sole structure 1310 using first attachment region 1540. In particular, in this case, lower portion 1404 is only attached to sole structure 1310 at first attachment region 1540 whose boundaries are defined by third line 1503 and fourth line 1504. First attachment region 1540 is a relatively narrow attachment region that may provide for increased decoupling between upper 1302 and sole structure 1310 at midfoot portion 12.

Because third line 1503 and fourth line 1504 are substantially curved, the width of attachment region 1540 varies along the length of connecting member 1400. For example, in the current embodiment, attachment region 1540 has width W21 at midfoot portion 12 and width W22 at heel portion 14. In this case, width W21 is substantially smaller than width W22. In other words, attachment region 1540 is larger at heel portion 14 than at midfoot portion 12. This arrangement may provide for enhanced decoupling at midfoot portion 12 over heel portion 14. Furthermore, as seen in FIG. 44, upper 1302 and sole structure 1310 are completely coupled along the full width of sole structure 1310 at forefoot portion 10 since connecting member 1400 does not extend through a majority of forefoot portion 10.

Figure 45:
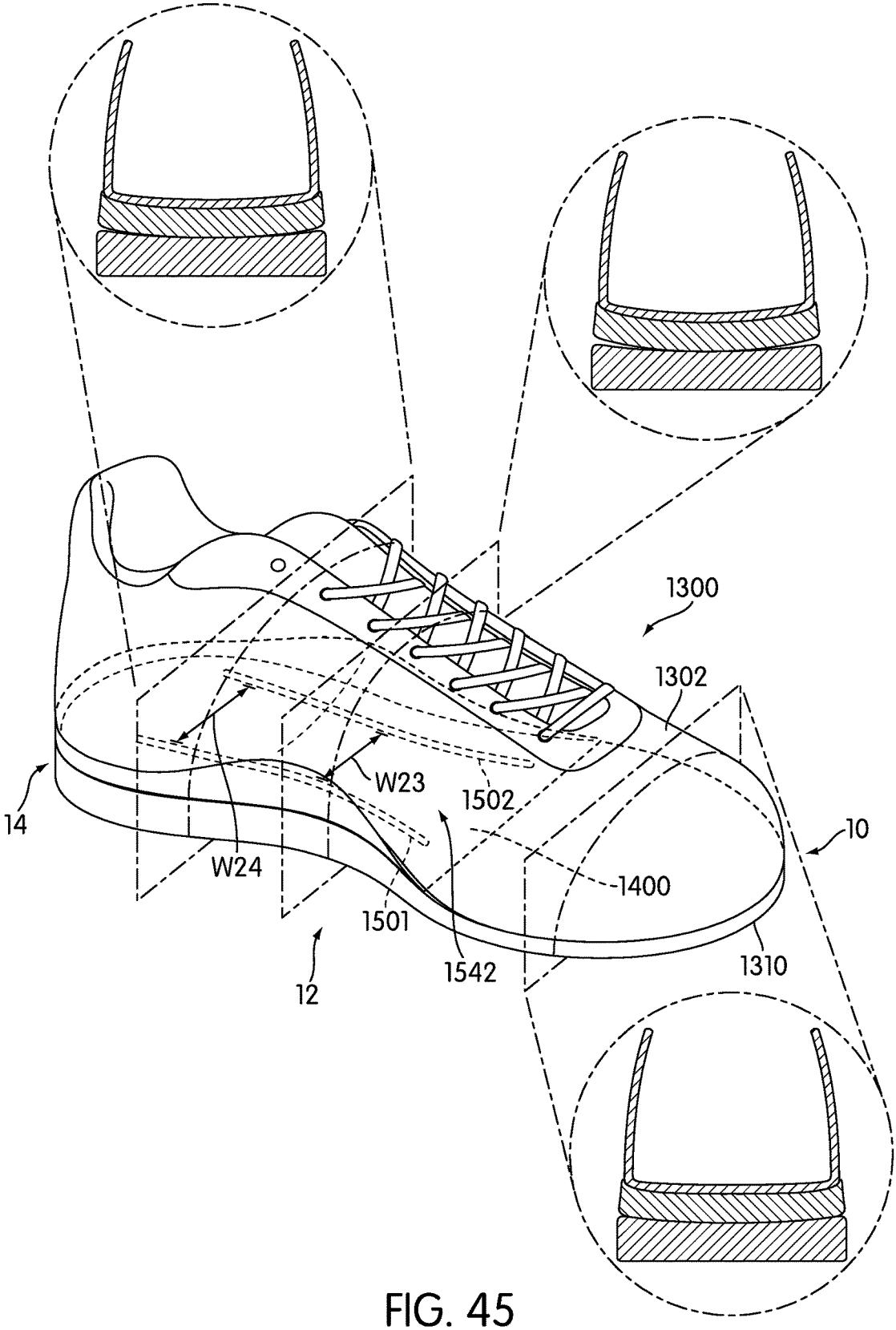
FIG. 45 is an isometric view of an embodiment of a connecting member attached to a sole structure using a second attachment region.

Referring now to FIG. 45, in another embodiment, connecting member 1400 may be attached to sole structure 1310 using second attachment region 1542. In this case, second attachment region 1542 is substantially wider than first attachment region 1540. In particular, second attachment region 1542 has width W23 at midfoot portion 12 and width W24 at heel portion 14. Both width W23 and width W24 are wider than both width W21 and width W22, which are associated with first attachment region 1540 and shown in FIG. 44. This configuration for connecting member 1400 may provide article 1300 with a greater degree of decoupling in midfoot portion 12 and heel portion 14 than the configuration shown in FIG. 44.

Figure 46:
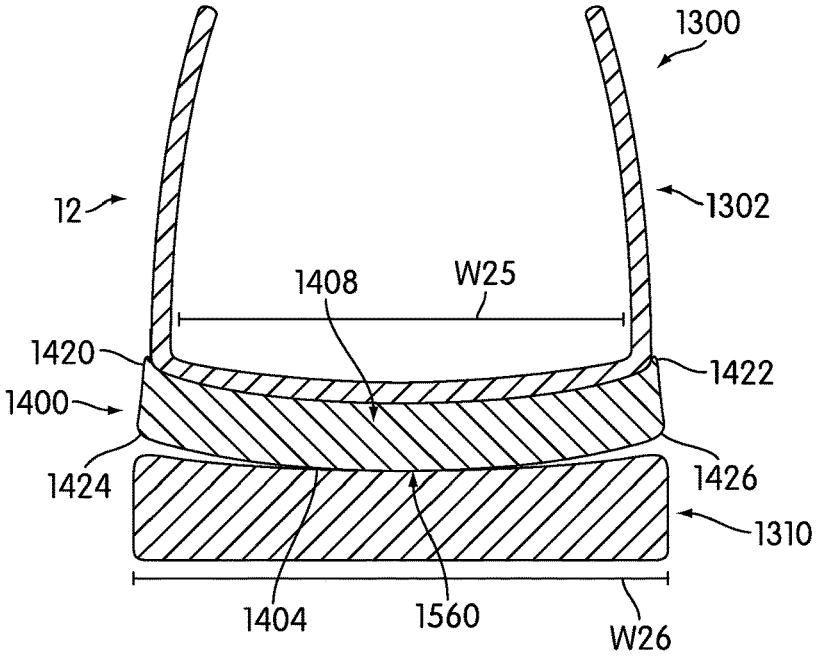
FIG. 46 is a cross-sectional view of an embodiment of an article of footwear.
Figure 47:
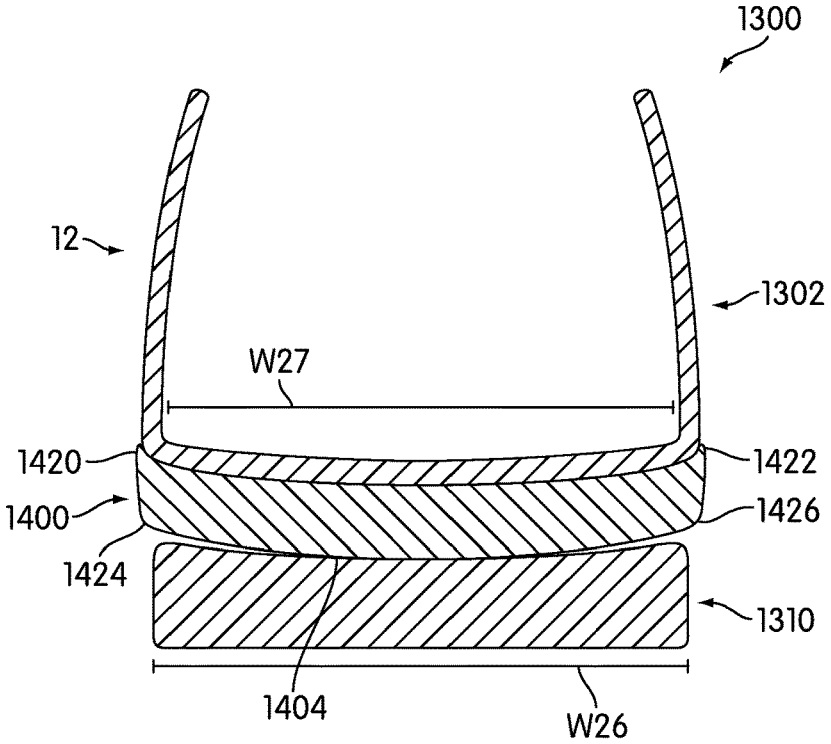
FIG. 47 is a cross-sectional view of an embodiment of an article of footwear.

FIGS. 46 and 47 illustrate cross-sectional views of an embodiment of article 1300 taken at midfoot portion 12. In this case, lower portion 1404 of connecting member 1400 may be connected to sole structure 1310 at attachment region 1560. With this arrangement, the lateral and medial sides of upper 1302 and sole structure 1310 may be decoupled at midfoot portion 12.

As illustrated in FIG. 46, upper 1302 may be configured with an initial width W25. In this position, width W25 of upper 1302 is less than width W26 of sole structure 1310. In this case, connecting member 1400 may be in a non-deformed state, with first upper peripheral edge 1420 and second upper peripheral edge 1422 disposed generally over first lower peripheral edge 1424 and second lower peripheral edge 1426, respectively.

Referring now to FIG. 47, upper 1302 may expand to width W27 to accommodate a foot of a larger width (not shown). In order to accommodate this larger width, first upper peripheral edge 1420 and second upper peripheral edge 1422 deform outwardly above first lower peripheral edge 1424 and second lower peripheral edge 1426, respectively. As already discussed, first upper peripheral edge 1420 and first lower peripheral edge 1424 are partially decoupled. Likewise, second upper peripheral edge 1422 and second lower peripheral edge 1426 are partially decoupled. In this stretched position, width W27 of upper 1302 is substantially greater than width W26 of sole structure 1310. This arrangement allows for the width of upper 1302 to be adapted to accommodate feet of varying widths at regions of article 1300 associated with connecting member 1400.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a longitudinal direction extending along a major axis of the article of footwear and a lateral direction extending along a minor axis of the article of footwear;

an upper and a sole structure;

a first side extending along the longitudinal direction of the article of footwear;

a second side extending along the longitudinal direction of the article of footwear; the first side being on an opposite side of the article of footwear from the second side;

a connecting member including a sheet of material, the sheet of material forming the connecting member being folded along the longitudinal direction in a linear orientation along an entire length of the connecting member such that the connecting member includes an upper layer and a lower layer;

the upper layer being attached to the upper along the first side and the lower layer being attached to the sole structure along the first side; the second side of the sole structure and the second side of the upper being directly coupled to each other;

the upper layer and the lower layer of the connecting member being decoupled from one another at the first side such that the upper layer is configured to move substantially independently of the lower layer at the first side, wherein the decoupled upper layer and the decoupled lower layer allow a lower periphery of the upper to move substantially independently of an upper periphery of the sole structure on the first side of the article of footwear; and wherein the first side is a medial side.

2. The article of footwear according to claim 1, wherein the connecting member is compressible.

3. The article of footwear according to claim 1, wherein the connecting member is configured to provide shock absorption for the article of footwear.

4. The article of footwear according to claim 1, wherein the connecting member extends through a midfoot portion of the article of footwear.

5. The article of footwear according to claim 4, wherein a majority of the connecting member is disposed in the midfoot portion.

6. The article of footwear according to claim 1, wherein the connecting member extends into a forefoot portion of the article of footwear.

7. The article of footwear according to claim 6, wherein a majority of the connecting member is disposed in the forefoot portion.

8. The article of footwear according to claim 1, wherein the connecting member extends into a heel portion of the article of footwear.

9. The article of footwear according to claim 8, wherein a majority of the connecting member is disposed in the heel portion.

10. The article of footwear according to claim 1, wherein when the upper layer moves away from the lower layer, a continuous, externally exposed open space is defined between: a fold line joining the upper layer and the lower layer, a free outer edge of the lower layer, and a free outer edge of the upper layer.

11. An article of footwear, comprising:

a longitudinal direction extending along a major axis of the article of footwear and a lateral direction extending along a minor axis of the article of footwear;

an upper and a sole structure; the upper having a length and a width, the sole structure having a length and a width;

a first side extending along the longitudinal direction of the article of footwear;

a second side extending along the longitudinal direction of the article of footwear; the first side being on an opposite side of the article of footwear from the second side;

a connecting member including a sheet of material, the sheet of material forming the connecting member being folded along the longitudinal direction in a linear orientation along an entire length of the connecting member such that the connecting member includes an upper layer and a lower layer;

the upper layer having a length and a width, and the lower layer having a length and a width, the upper layer also having a thickness and the lower layer also having a thickness;

the width of the upper layer being substantially equal to the width of the lower layer; the width of the upper layer being approximately half of the width of the upper, and the width of the lower layer being approximately half of the width of the sole structure;

the upper layer being attached to the upper along the first side and the lower layer being attached to the sole structure along the first side;

the second side of the sole structure and the second side of the upper being directly coupled to each other; the upper layer and the lower layer of the connecting member being decoupled from one another at the first side such that the upper layer is configured to move substantially independently of the lower layer at the first side;

wherein the thickness of the upper layer is substantially less than the width of the upper layer and wherein the thickness of the lower layer is substantially less than the width of the lower layer; and wherein the first side is a medial side.

12. The article of footwear according to claim 11, wherein the width of the upper, the width of the sole structure, the width of the upper layer and the width of the lower layer extend along the lateral direction.

13. The article of footwear according to claim 12, wherein the upper layer is substantially parallel to the lower layer.

14. The article of footwear according to claim 12, wherein the upper layer is attached to a periphery of a lower portion of the upper at the first side.

15. The article of footwear according to claim 12, wherein the connecting member extends into a heel region of the article of footwear.

16. The article of footwear according to claim 11, wherein when the upper layer moves away from the lower layer, a continuous, externally exposed open space is defined between: a fold line joining the upper layer and the lower layer, a free outer edge of the lower layer, and a free outer edge of the upper layer.

17. The article of footwear according to claim 11, wherein the connecting member extends into a forefoot portion of the article of footwear.

18. The article of footwear according to claim 17, wherein a majority of the connecting member is disposed in the forefoot portion.

* * * * *